US005651263A

United States Patent [19]

Nonaka et al.

[11] Patent Number: 5,651,263

[45] Date of Patent: Jul. 29, 1997

[54] REFRIGERATION CYCLE AND METHOD OF CONTROLLING THE SAME

[75] Inventors: Masayuki Nonaka, Ibaraki-ken; Hiroaki Matsushima, Ryugasaki; Kazuhiro Endoh, Ibaraki-ken; Kensaku Oguni, Shimizu; Kazumoto Urata, Shizuoka; Kyuhei Ishibane; Takeshi Endoh, both of Shimizu, all of Japan

[73] Assignee: Hitachi, Ltd., Tokyo, Japan

[21] Appl. No.: 330,677

[22] Filed: Oct. 28, 1994

[30] Foreign Application Priority Data

Oct. 28, 1993 [JP] Japan ..... 5-270378
May 30, 1994 [JP] Japan ..... 6-116828

[51] Int. Cl.[6] ..... F25B 41/04; F25B 1/00

[52] U.S. Cl. ..... 62/205; 62/502

[58] Field of Search ..... 62/502, 205, 225

[56] References Cited

U.S. PATENT DOCUMENTS 3,203,194 8/1965 Fuderer ..... 62/502 X
4,624,114 11/1986 Sakuma et al. ..... 62/502
5,186,011 2/1993 Yoshida et al. ..... 62/114
5,353,604 10/1994 Oguni et al. ..... 62/502 X

OTHER PUBLICATIONS

Japanese Patent Unexamined Publication No. 62–80471 Apr. 1987.

Japanese Patent Unexamined Publication No. 61–99066 May 1986.

Japanese Patent Unexamined Publication No. 1–58964 Mar. 1989.

Lecture Paper p. 41 of Scientific Lecture Meeting in 1993, Japan Refrigeration Association.

*Primary Examiner*—William E. Wayner
*Attorney, Agent, or Firm*—Antonelli, Terry, Stout & Kraus, LLP

[57] ABSTRACT

A refrigeration cycle comprises a compressor, an indoor heat exchanger, an outdoor heat exchanger, a liquid receiver; and a pressure reducer connected in series to form a closed loop. The liquid receiver and the pressure reducer connected in series are connected between the indoor heat exchanger and said outdoor heat exchanger. A non-azeotropic mixture refrigerant comprising at least two kinds of refrigerant of different boiling temperatures mixed together is charged in and circulated through the refrigeration cycle. The mixing ratio of the azeotropic mixture refrigerant circulated thorough the refrigeration cycle is controlled substantially constant.

9 Claims, 12 Drawing Sheets

REFRIGERATION CYCLE AND METHOD OF CONTROLLING THE SAME

BACKGROUND OF THE INVENTION

Field of the Invention

The present invention relates to a refrigeration cycle and a method of controlling the same, as well as to an air conditioner. More particularly, the present invention is concerned with a refrigeration cycle which operates with a non-azeotropic mixture refrigerant charged therein, improved to suppress change in the nature of the refrigerant while reducing the amount of refrigerant to be used in the cycle, and also to a method of controlling such a refrigeration cycle and further to an air conditioner incorporating such a refrigeration cycle.

Hitherto, various techniques have been proposed for effecting capacity control of refrigeration cycle by varying the composition ratio of a non-azeotropic mixture refrigerant circulated through the refrigeration cycle.

For instance, Japanese Patent Unexamined Publication No. 61-99066 discloses a heat pump wherein a non-azeotropic mixture refrigerant is introduced into a refrigerant rectifier tower through a three-way valve which is switchable to selectively direct the refrigerant either to the top or the bottom of a rectifier tower, so as to make it possible to largely vary the composition of the refrigerant circulated through the main circuit, whereby the refrigerant composition is controlled continuously to match with the level of the refrigeration load.

Japanese Patent Laid-Open No. 1-58964 discloses a heat pump system in which a gas-liquid separator is connected between an indoor heat exchanger and an outdoor heat exchanger, and a refrigerant tank which is capable of performing heat exchange with a suction gas pipe is connected through a first connecting pipe to an upper part of the gas-liquid separator, the refrigerant tank also being connected to a lower part of the gas-liquid separator through a second connecting pipe having a stop valve, thus forming refrigeration cycle which operates with a non-azeotropic mixture refrigerant. During operation of the refrigeration cycle in cooling mode, gaseous refrigerant rich in low-boiling-point component flowing out from the upper part of the gas-liquid separator is introduced into the refrigerant tank so as to be condensed into liquid phase and is stored therein as liquid refrigerant, whereby a refrigerant rich in high-boiling-point component is circulated through the refrigeration cycle.

Another refrigeration cycle system also has been proposed in which, in order to facilitate maintenance work, the refrigeration cycle is initially charged with refrigerant of an amount corresponding to the internal volume of the maximum length of the connecting piping. In this type of refrigeration cycle, it is necessary to employ a tank to accommodate any surplus refrigerant which is generated when the length of the connecting piping actually used in the operation is short. Conventionally, there are two types of methods for accommodating such surplus refrigerant.

One of these methods employs a liquid receiver as means for accommodating surplus refrigerant, provided at the downstream side of a heat exchanger which serves as a condenser, while the other method, which is disclosed in Japanese Patent Unexamined Publication No. 62-80471, employs an accumulator as means for accommodating surplus refrigerant, provided at the suction portion of the refrigeration cycle.

A description will be given of the refrigeration cycles having means for accommodating surplus refrigerant and charged with non-azeotropic mixture refrigerants. In the refrigeration cycle of the type which employs a liquid receiver, high-pressure refrigerant discharged from the condenser flows into the liquid receiver so as to be stored therein as the surplus refrigerant. The refrigerant flowing into the liquid receiver has a very small degree of quality so that the refrigerant stored in the liquid receiver approximates that of the refrigerant initially charged. Consequently, the composition of the mixture refrigerant circulated through the refrigeration cycle approximates that of the initially charged refrigerant. In contrast, in the refrigeration cycle of the type which employs an accumulator disposed at the suction portion of the refrigeration cycle, refrigerant of a low pressure coming from the evaporator is introduced into the accumulator so as to be accumulated therein as surplus refrigerant. The refrigerant flowing into the accumulator has a very large degree of quality, so that the refrigerant accumulated in the accumulator has a composition which is richer in the high-boiling-point component than the initially charged refrigerant. Consequently, the composition of the mixture refrigerant circulated through the refrigeration cycle is richer in the low-boiling-point component than the composition of the initially charged refrigerant.

In these known methods which employ a mixture refrigerant to enable a change in the composition of the circulated refrigerant or which incorporates means for storing or accumulating surplus refrigerant, no specific consideration is given to adaptability to variation in the length of the piping interconnecting the indoor unit and the outdoor unit nor to protection of global environment.

More specifically, in the known refrigeration system which employs a rectifier tower for varying the composition of the refrigerant circulated through the refrigeration cycle, no surplus refrigerant exists when the length of the piping actually used equals to the maximum design length. In such a case, no fraction of the refrigerant is stored in the refrigerant storage tank and, therefore, it is impossible to vary the composition of the refrigerant circulated through the refrigeration cycle. Conversely, when the refrigerant is stored in the tank to enable control of the composition of the circulated refrigerant, the effective amount of the refrigerant circulated through the refrigeration cycle becomes insufficient, with the result that the efficiency of the refrigeration cycle is reduced. When the amount of the initial charge of the refrigerant is increased to optimize the effective amount of refrigerant circulated through the refrigeration cycle, the amount of refrigerant leaking from the refrigeration cycle or freed when the refrigeration cycle is disposed is increased to accelerate the warming of the air on the earth.

The known refrigeration cycle of the type employing a gas-liquid separator to enable control of the composition of the circulated refrigerant makes it possible to enrich the refrigerant in high-boiling-point component during cooling operation. In the operation in heating mode, however, the liquid refrigerant in the refrigerant tank evaporates to flow into the gas-liquid separator, so that the composition of the circulated refrigerant is rendered rich in low-boiling-point component. Thus, the composition of the circulated refrigerant is changed according to the mode of the operation. This poses problems when the compressor is driven by a constant-speed motor, such as a large difference in the power between the heating and cooling operations, or rise of the refrigerant pressure to a level exceeding the maximum allowable pressure in the refrigeration cycle.

The known refrigeration cycle employing an accumulator as means for accumulating surplus refrigerant has suffered from the following disadvantage, since this type of refrigeration cycle has not been designed to use a non-azeotropic mixture refrigerant.

Namely, a liquid receiver is essentially required to accommodate a change in the rate of circulation of the refrigerant which varies according to the thermal load during the operation of the refrigeration cycle in the cooling or heating mode. Meanwhile, non-azeotropic mixture refrigerant exhibits different compositions depending on whether it is in liquid phase or gaseous phase, as shown in FIG. 12. In the refrigeration cycle in which the liquid receiver is connected between the heat exchanger serving as an evaporator and the compressor of the cycle, when the refrigerant flowing into the liquid receiver has a large degree of quality (composition A in FIG. 12), refrigerant of a composition (composition B in FIG. 12) rich in HFC-134a, which is a high-boiling-point component of the refrigerant, is stored in the liquid receiver. Therefore, in steady operation of the refrigeration cycle, a refrigerant rich in HFC-32 is circulated through the refrigeration cycle. Thus, the composition of the refrigerant circulated through the refrigeration cycle differs from that of the initially charged refrigerant. HFC-32 is the low-boiling-point component so that enrichment in this component causes a rise in the operation pressure of the refrigeration cycle, causing the pressure at the high-pressure side to exceed the maximum allowable pressure of the refrigeration cycle. The increased pressure also enhances the tendency of leak of the refrigerant. Leakage of HFC-32 is dangerous because this component is inflammable.

In some cases, component or components such as a liquid receiver are beforehand charged with the refrigerant and then connected. The liquid receiver is required to accommodate any surplus refrigerant also in these cases, when the length of the piping actually used is small. Consequently, the same problems as those stated above have been encountered.

SUMMARY OF THE INVENTION

An object of the present invention is to provide a refrigeration cycle which can suppress any change in the composition of the refrigerant circulated through the refrigeration cycle and which can extend the limit of operating conditions of the refrigeration cycle, while reducing the amount of refrigerant required in the refrigeration cycle, thereby overcoming the above-described problems of the known arts.

Another object of the present invention is to provide a refrigeration cycle in which any surplus refrigerant can be better stored in a liquid state having a very small degree of quality such as that obtained at the outlet of a condenser.

Still another object of the present invention is to provide a method of controlling a refrigeration cycle, capable of expanding the range of operation of the refrigeration cycle while enabling optimization of the operating condition, and realizing such a control of an air conditioner as to optimize the operation of the refrigeration cycle for the air to be conditioned and, at the same time, realizing various modes of air conditioning operation as required by the user.

To these ends, according to one aspect of the present invention, there is provided a refrigeration cycle comprising: a compressor; an indoor heat exchanger; an outdoor heat exchanger; a liquid receiver; a pressure reducer, the liquid receiver and the pressure reducer connected in series being connected between the indoor heat exchanger and the outdoor heat exchanger; a non-azeotropic mixture refrigerant comprising at least two kinds of refrigerants of different boiling temperatures mixed together and charged in and circulated through the refrigeration cycle; and means for maintaining a constant mixing ratio of the non-azeotropic mixture refrigerant circulated through the refrigeration cycle.

The invention also provides a refrigeration cycle wherein a liquid receiver is connected between the indoor heat exchanger and the outdoor heat exchanger, and a gas-liquid mixing device for mixing gas and liquid is disposed at the outlet side of the piping connected to the liquid receiver as viewed in the direction of flow of the refrigerant flowing through the piping so that the refrigeration cycle is controlled such that the refrigerant at the inlet to the liquid receiver is a two-phase mixture comprising gaseous phase and liquid phase or such that the pressure inside the liquid receiver is maintained intermediate between the pressure of the high-pressure side and the pressure of the low-pressure side of the refrigeration cycle.

The invention also provides a refrigeration cycle wherein the liquid receiver is disposed at an intermediate-pressure region of the refrigeration cycle, and a gas-liquid mixing device which maintains the refrigerant flowing into or flowing out the liquid receiver in the state of a two-phase mixture comprising both gaseous and liquid phases of the refrigerant.

The invention also provides a refrigeration cycle of the type mentioned above, wherein the gas-liquid mixing device comprises a gas pipe which extracts the gaseous phase of the refrigerant in the liquid receiver from the top of the liquid receiver, a liquid pipe for extracting the liquid phase of the refrigerant from the liquid receiver, and pressure reducing means provided in the liquid pipe.

The present invention also provides a refrigeration cycle wherein the gas-liquid mixing device comprises a gas extraction opening through which gaseous phase is extracted from the liquid receiver, a liquid extraction opening through which liquid phase is extracted from the liquid receiver, and a refrigerant outlet pipe for mixing the extracted gaseous phase and liquid phase together and delivering the mixture.

At least one of the first and second pressure reducers disposed upstream and downstream of the liquid receiver may be an electronic expansion valve.

The present invention in its another aspect provides a refrigeration cycle control method for controlling a refrigeration cycle of the type which comprises, at least, a compressor, a four-way valve, an indoor heat exchanger, a first pressure reducer, a liquid receiver, a second pressure reducer, an outdoor heat exchanger, a piping sequentially connecting the compressor, the four-way valve, the indoor heat exchanger, the first pressure reducer, the liquid receiver, the second pressure reducer and the outdoor heat exchanger, and a non-azeotropic mixture refrigerant charged in the refrigeration cycle, comprising at least two kinds of refrigerants of different boiling temperatures mixed together, the refrigeration cycle control method comprising operating at least one of the first and second pressure reducers such that the degree of the refrigerant subcooling in one of the indoor and outdoor heat exchangers serving as a condenser or the pressure in the liquid receiver is controlled by one of the first and second pressure reducers which is upstream of the liquid receiver as viewed in the direction of flow of the refrigerant, while the degree of super-heating of the gaseous phase of the refrigerant discharged by the compressor or sucked into the compressor is controlled by the pressure reducer which is disposed downstream of the liquid receiver.

According to the present invention, the liquid receiver is disposed between an indoor heat exchanger and an outdoor heat exchanger, and a gas-liquid mixing device is connected to the outlet side of the piping connected to the liquid receiver as viewed in the direction of the refrigerant. The refrigerant at the inlet side of the liquid receiver is in the state of a two-phase mixture containing both a gaseous phase and liquid phase or, alternatively, the pressure inside the liquid receiver is held at a level which is intermediate between the pressures of the high-pressure and low-pressure sides of the refrigeration cycle. Any surplus refrigerant generated in the refrigeration cycle is stored in the liquid receiver, since the gas-liquid mixing device acts to cause the refrigerant to flow out the liquid receiver in the same state as wet liquid or at the same degree of quality as the refrigerant flowing into the liquid receiver or in a dry state. Consequently, liquid refrigerant of a composition approximating that of the initially charged refrigerant is stored in the liquid receiver. This means that the difference in the composition between the refrigerant actually circulated through the refrigeration cycle and the initially charged refrigerant is reduced. Namely, the change in the composition of the liquid refrigerant is reduced so as to suppress the rise in the operation pressure of the refrigeration cycle, thus expanding the range of operation of the refrigeration cycle. Furthermore, since the refrigerant flowing through the piping upstream and downstream of the liquid receiver has the form of a two-phase mixture, the mass of the refrigerant contained in the piping is reduced so as to make it possible to reduce the amount of the refrigerant used in the whole refrigeration cycle. This means that the amount of the refrigerant to be used in the refrigeration cycle can be decreased even when the overall length of the piping is comparatively large, making it possible to improve the efficiency of operation of the refrigeration cycle.

In another form of the present invention, the liquid receiver is provided at an intermediate-pressure region of the refrigeration cycle. At the same time, a gas-liquid mixing device is disposed such that the refrigerant flowing into or out of the liquid receiver has the state of two-phase mixture comprising gaseous phase and liquid phase. Therefore, in this form of the invention also, the surplus refrigerant can be stored in the form of a liquid refrigerant which has a small degree of quality as that at the condenser outlet. Consequently, the liquid refrigerant stored in the liquid receiver has a composition approximating that of the initially charged refrigerant, so that the rise of the operation pressure of the refrigeration cycle is suppressed to make it possible to expand the range of operation of the refrigeration cycle. Furthermore, since the refrigerant flowing through the piping upstream and downstream of the liquid receiver has the form of a two-phase mixture, the mass of the refrigerant contained in the piping is reduced so as to make it possible to reduce the amount of the refrigerant used in the whole refrigeration cycle. This means that the amount of the refrigerant to be used in the refrigeration cycle can be decreased even when the overall length of the piping is comparatively large, making it possible to improve the efficiency of operation of the refrigeration cycle.

In one form of the invention, the gas-liquid mixing device has a gas pipe for extracting gaseous phase from an upper part of the liquid receiver, a liquid pipe through which liquid phase in the liquid receiver is extracted, and pressure reducing means provided in the liquid pipe. The liquid receiver receives the refrigerant in the form of a two-phase mixture. The gaseous phase and the liquid phase of the refrigerant in the liquid receiver are respectively extracted through the gas pipe and the liquid pipe and are then mixed together. During the mixing, the pressure reducing means provided in the liquid pipe functions so that the mixture refrigerant has the same degree of quality or wetness the two-phase mixture flowing into the liquid receiver or a grater degree of quality than the two-phase mixture. Therefore, when any surplus refrigerant is generated in the refrigeration cycle, the liquid receiver can store liquid refrigerant of a composition which approximates that of the initially charged refrigerant. In addition, it is possible to always extract refrigerant in the state of the two-phase mixture from the liquid receiver through the gas-liquid mixing device.

In a different form of the present invention, the gas-liquid mixing device includes a gas extraction opening through which the gaseous phase of the refrigerant is extracted from the liquid receiver, a liquid extraction opening through which the liquid phase of the refrigerant is extracted from the liquid receiver, and an outlet pipe in which the extracted gaseous and liquid phases are mixed and then delivered therefrom. The liquid refrigerant stored in the liquid receiver has a composition approximating that of the initially charged refrigerant also in this case. In addition, it is possible to constantly extract refrigerant in the state of the two-phase mixture from the liquid receiver through the gas-liquid mixing device.

The refrigeration cycle can be adequately controlled in an adaptive manner when an electronic expansion valve is used as at least one of the first and second pressure reducers.

In one form of the present invention, the degree of subcooling of the liquid refrigerant in the heat exchanger serving as the condenser or the pressure inside the liquid receiver is controlled by one of the first and second pressure reducers which is disposed upstream of the liquid receiver. At the same time, the degree of superheating of the gaseous refrigerant discharged from or sucked into the compressor is controlled by the pressure reducer which is disposed downstream of the liquid receiver. When the cooling requirement of air is high, the pressure reducer upstream of the liquid receiver functions to suppress rise of the discharge pressure, while the amount of liquid back to the compressor is optimized by the pressure reducer which is downstream of the liquid receiver, whereby refrigeration cycle can operate over a wider range of operation under optimum conditions. The operation of the refrigeration cycle can be set to a mode which gives a greater importance to saving of energy or to a mode which give preference to capacity, by setting the degree of subcooling of the refrigerant at the condenser outlet or the pressure inside the liquid receiver to a suitable level. It is therefore possible to operate the refrigeration cycle in a fashion which is optimum for the space to be air-conditioned or which is desired by the user.

To this end, in still another aspect of the present invention, there is provided an air conditioner incorporating a refrigeration cycle operable both in heating and cooling mode, the refrigeration cycle including a compressor, a refrigerant flow passage changeover device, an indoor heat exchanger, an outdoor heat exchanger, a liquid receiver and a pressure reducer, the liquid receiver and the pressure reducer connected in series being provided between the indoor heat exchange and the outdoor heat exchanger, and a non-azetropic mixture refrigerant charged in the refrigeration cycle, comprising at least two kinds of refrigerant of different boiling temperatures mixed together, the air conditioner comprising a refrigerant flow passage changeover means which selectively provide communication between the refrigerant passage between the indoor heat exchanger and the liquid receiver, the refrigerant passage between the outdoor heat exchanger and the liquid receiver, the refrigerant passage between the indoor heat exchanger and the pressure reducer and the refrigerant passage between the outdoor heat exchanger and the pressure reducer.

In heating mode of operation of the air conditioner of the invention having the features stated above, the refrigerant gas compressed to high pressure and temperature is introduced through the refrigerant passage changeover device to the indoor heat exchanger so as to be condensed therein while giving heat to air which is blown through the indoor heat exchanger by an indoor blower. In non-steady state of the operation, any surplus refrigerant is stored in the liquid phase. However, since the degree of quality of the refrigerant flowing into the liquid receiver is small, the difference in composition between the refrigerant flowing into the liquid receiver and the refrigerant stored in the liquid receiver is small. Consequently, in steady state of operation also, the difference in the composition between the initially charged refrigerant and the refrigerant actually circulated is small. The refrigerant flowing out the liquid receiver encounters with a pressure reduction across the pressure reducer and is introduced through the refrigerant passage changeover device into the outdoor heat exchanger which in this case serves as a low-pressure heat exchanger, so that the refrigerant is evaporated by the heat derived from the air blown by the outdoor heat exchanger and sucked into the compressor, thus completing the refrigeration cycle.

In the cooling mode of operation of this air conditioner, the refrigerant gas compressed to high pressure and temperature is introduced through the refrigerant passage changeover device into the outdoor heat exchanger so as to be condensed therein by giving heat to the air which is blown through the outdoor heat exchanger by an outdoor blower. The condensed refrigerant is then allowed to flow into the liquid receiver in the same direction as that in the heating mode operation, through the refrigerant passage changeover device. As stated above, the refrigerant flowing into the liquid receiver has a small degree of quality and, hence, exhibits only a small difference in composition from the liquid refrigerant flowing out the liquid receiver. The refrigerant flowing out the liquid receiver encounters with a pressure reduction across the pressure reducer and is introduced through the refrigerant passage changeover device into the indoor heat exchanger which in this case serves as a low-pressure heat exchanger, so that the refrigerant is evaporated by the heat derived from the air blown by the indoor heat exchanger and sucked into the compressor, thus completing the refrigeration cycle.

Therefore, even when the level of load is changed in a refrigeration cycle operating with a non-azetropic mixture refrigerant, the refrigerant flowing into the liquid receiver has a small degree of quality regardless of whether the operation mode is cooling mode or heating mode, thus making it possible to minimize the difference in composition between the refrigerant circulated through the refrigeration cycle and the initially charged refrigerant, both in cooling and heating modes of operation of the air conditioner. Furthermore, since only one pressure reducer is used, the control system can be simplified as compared with the cases where a plurality of pressure reducers are used.

DESCRIPTION OF THE PREFERRED EMBODIMENTS

Embodiments of the present invention will now be described with reference to the drawings.

Figure 1:
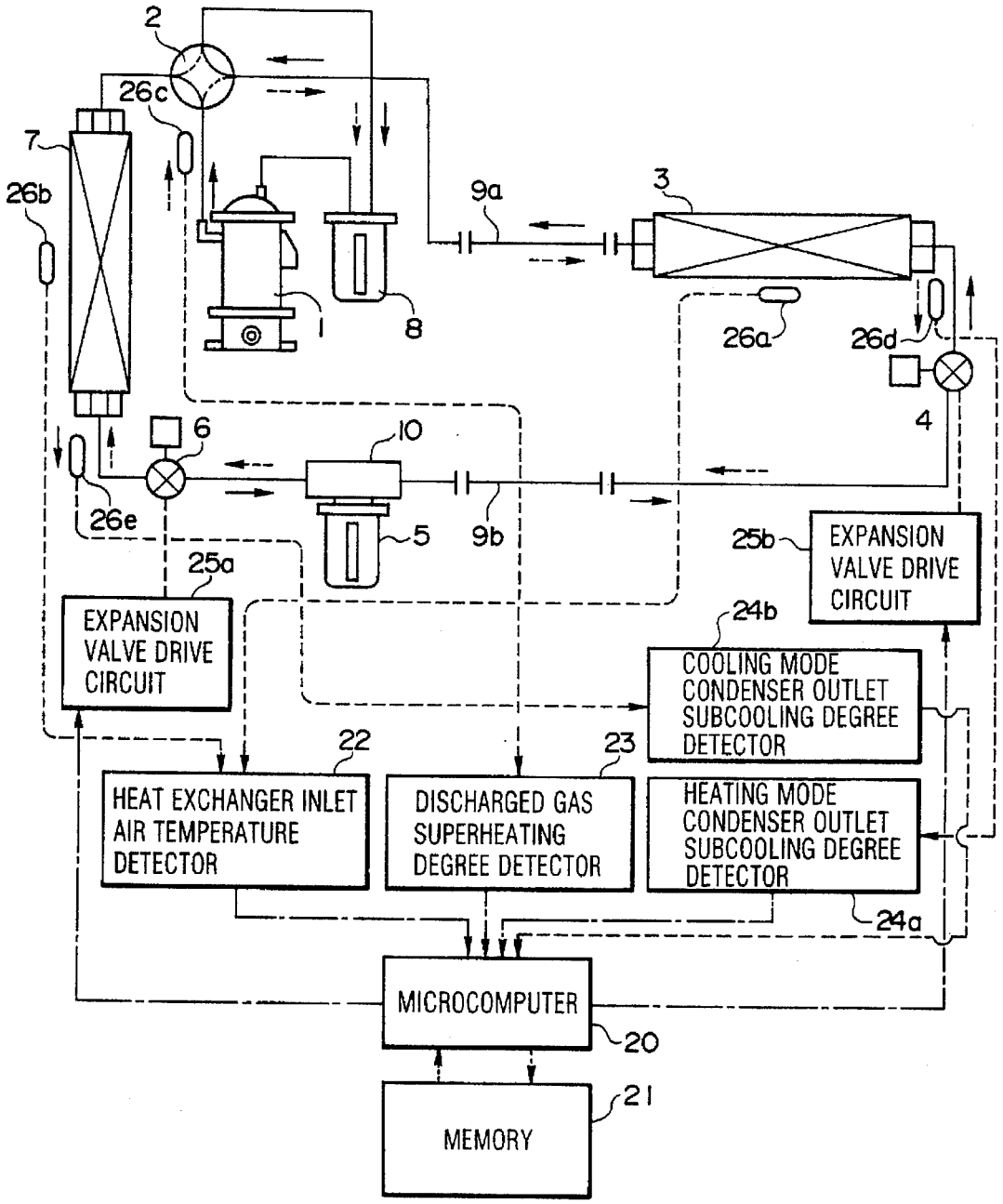
FIG. 1 is a diagram showing the construction of an embodiment of a refrigeration cycle in accordance with the present invention.

FIG. 1 illustrates a system of an embodiment of a refrigeration cycle according to the present invention.

The refrigeration cycle of this embodiment shown in FIG. 1 is constructed in a closed loop in such a way that a compressor 1, a four-way valve 2, an indoor heat exchanger 3, a first pressure reducer 4, a liquid receiver 5, a second pressure reducer 6 and an outdoor heat exchanger 7 are sequentially connected via gas connecting piping 9*a*, liquid connecting piping 9*b*, and so forth.

Connected to the compressor 1 is an accumulator 8 for adjusting the return volume of a liquid refrigerant. The liquid receiver 5 is arranged between the first pressure reducer 4 provided for the indoor heat exchanger 3 and the second pressure reducer 6 provided for the outdoor heat exchanger 7 so that a surplus refrigerant generated in the piping of the refrigeration cycle can be stored or accumulated within the liquid receiver 5. A gas-liquid mixing device 10 is provided for the liquid receiver 5 and is constructed to be able to adjust a liquid refrigerant and a gaseous refrigerant to a predetermined quality or wetness. The foregoing refrigeration cycle is charged with at least two types of refrigerants at different boiling points whose amount corresponds to the internal volume of the maximum length of the connecting piping so that they flow in the refrigeration cycle as indicated by the arrows in the solid lines and broken lines. A non-azetropic refrigerant mixture, such as HFC-32/134a, HFC-32/125/134a, or the like, is used as the refrigerant.

Further, a control system for controlling the refrigeration cycle is connected thereto, as described below.

An explanation will now be given of the cooling operation and the heating operation in the foregoing refrigeration cycle.

(1) Operation in Cooling Mode

The four-way valve 2 is switched as indicated by the solid lines so as to allow a refrigerant to flow as indicated by the arrows in the solid lines in the order of the compressor 1, the four-way valve 2, the outdoor heat exchanger 7, the second pressure reducer 6, the liquid receiver 5, the first pressure reducer 4, the indoor heat exchanger 3, the four-way valve 2 and the accumulator 8. The mixture refrigerant is compressed into a gaseous refrigerant at a high temperature and a high pressure by the compressor 1. Then, in the outdoor heat exchanger 7, the gaseous refrigerant emits heat to the air circulating in the outdoor heat exchanger 7 so as to be condensed into a liquid refrigerant. Such a liquid refrigerant encounters with a pressure reduction across the second pressure reducer 6 so as to be transformed into the refrigerant in the form of a two-phase mixture comprising a gaseous phase and a liquid phase and to be introduced into the liquid receiver 5. Subsequently, the gas-liquid mixing device 10 acts to cause the refrigerant to flow out the liquid receiver in the same state at the same degree of quality or wetness as the refrigerant flowing into the liquid receiver or in a dry state. The resultant refrigerant is introduced into the liquid connecting piping **9*b*. The refrigerant further encounters with a pressure reduction across the first pressure reducer 4 to a predetermined pressure. It then flows into the indoor heat exchanger 3 in which it absorbs heat from the air circulating in the indoor heat exchanger 3 so as to be transformed into the form of a two-phase mixture or a gaseous phase by evaporation. The resultant refrigerant further flows into the accumulator 8 via the four-way valve 2. The refrigerant which will be returned into the compressor 1 has its quality or wetness adjusted in the accumulator 8 so as to be sucked into the compressor 1**.

A description will now be given of the states of the mixture refrigerant when it is within the accumulator 8 and within the liquid receiver 5.

Figure 2:
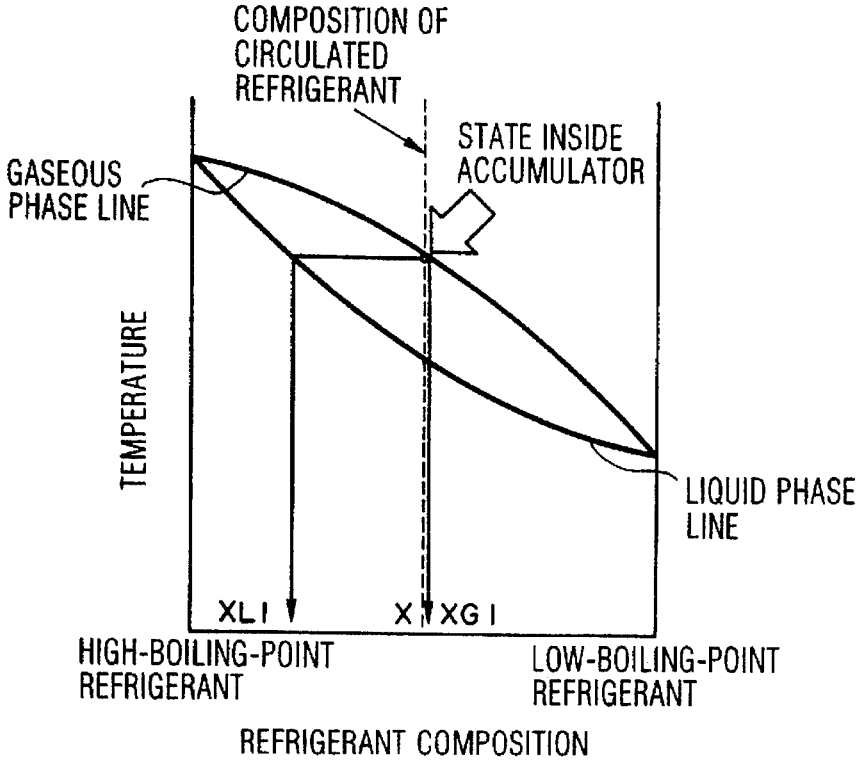
FIG. 2 is a diagram illustrative of a gas-liquid equilibrium state of a mixture refrigerant in an accumulator.
Figure 3:
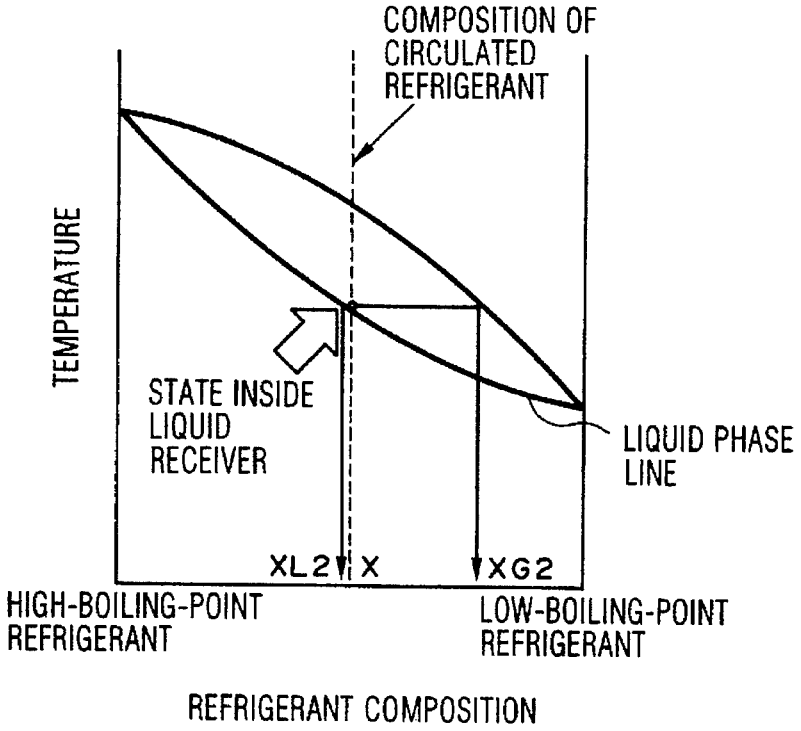
FIG. 3 is a diagram illustrative of a gas-liquid equilibrium state of a mixture refrigerant in a liquid receiver.

FIG. 2 is a gas-liquid equilibrium diagram of the state of the refrigerant mixture within the accumulator 8. FIG. 3 is a gas-liquid equilibrium diagram of the state of the refrigerant mixture within the liquid receiver 5. An explanation will be given of a mixture of two types of refrigerants having different boiling points as a matter of convenience.

The refrigerant flowing into the accumulator 8 is an superheated gaseous refrigerant or a refrigerant in the form of a two-phase mixture having a large degree of quality. A liquid phase and a gaseous phase separately coexist within the accumulator 8. The mixture ratio of such phases in relation to the composition X of the initially charged refrigerant is such that the liquid phase has a composition of XL1 which is richer in the high-boiling point component, while the gaseous phase has a composition of XG1 which approximates the composition X of the initially charged refrigerant. On the other hand, the refrigerant flowing into the liquid receiver 5 is a refrigerant in the form of a two-phase mixture having a small degree of quality. A liquid phase and a gaseous phase separately coexist within the liquid receiver 5. The mixture ratio of such phases in relation to the composition X of the initially charged refrigerant is such that the gaseous phase has a composition of XG2 which is richer in the low-boiling point component, while the liquid phase has a composition of XL2 which approximates the composition X of the initially charged refrigerant. A surplus refrigerant is generated if the connection piping for connecting the indoor and outdoor units is short. However, the gas-liquid mixing device 10 acts to cause the refrigerant to flow out the liquid receiver in the same state at the same degree of quality or wetness as the refrigerant flowing into the liquid receiver or in a dry state. Thus, the surplus refrigerant is stored or accumulated in the liquid receiver 5. That is, the liquid refrigerant having a composition approximating that of the initially charged refrigerant is stored or accumulated within the liquid receiver 5, thus reducing a disparity of the composition between the refrigerant actually circulating in the refrigeration cycle and the initially charged refrigerant, thereby inhibiting a change in the composition of the refrigerant. Also, the refrigerant flowing through the liquid connecting piping **9*b* is transformed into the form of a two-phase mixture by the gas-liquid mixing device 10, thus reducing the mass of the refrigerant contained in the liquid connecting piping 9*b***, thereby reducing the amount of the refrigerant in the overall refrigeration cycle.

(2) Operation in Heating Mode

The four-way valve 2 is switched as indicated by the broken lines so as to allow a refrigerant to flow as indicated by the arrows in the broken lines in the order of the compressor 1, the four-way valve 2, the indoor heat exchanger 3, the first pressure reducer 4, the liquid receiver 5, the second pressure reducer 6, the outdoor heat exchanger 7, the four-way valve 2 and the accumulator 8. The refrigerant mixture is compressed into a gaseous refrigerant at a high temperature and a high pressure by the compressor 1. Then, in the indoor heat exchanger 3, the gaseous refrigerant emits heat to the air circulating in the indoor heat exchanger 3 so as to be condensed into a liquid refrigerant. Such a liquid refrigerant encounters with a pressure reduction across the first pressure reducer 4 so as to be transformed into the refrigerant in the form of a two-phase mixture and to be introduced into the liquid receiver 5 via the liquid connecting piping **9*b*. Subsequently, the gas-liquid mixing device 10 acts to cause the refrigerant to flow out the liquid receiver in the same state at the same degree of quality or wetness as the refrigerant flowing into the liquid receiver or in a dry state. The refrigerant further encounters with a pressure reduction across the second pressure reducer 6 to a predetermined pressure. Then, the refrigerant in the form of a two-phase mixture flows into the outdoor heat exchanger 7 in which it absorbs heat from the air circulating in the outdoor heat exchanger 7 so as to be evaporated. The resultant refrigerant further flows into the accumulator 8 via the four-way valve 2. The refrigerant which will be returned to the compressor 1 has its quality or wetness adjusted in the accumulator 8 so as to be sucked into the compressor 1**.

The states of the refrigerant mixture when it is within the accumulator 8 and the liquid receiver 5 are similar to those described above in the operation in the cooling mode.

A surplus refrigerant is generated if the connection piping for connecting the indoor and outdoor units is short. However, the gas-liquid mixing device 10 acts to cause the refrigerant to flow out the liquid receiver in the same state at the same degree of quality or wetness as the refrigerant flowing into the liquid receiver or in a dry state. Thus, the surplus refrigerant is stored or accumulated in the liquid receiver 5. That is, the liquid refrigerant having a composition approximating that of the initially charged refrigerant is stored or accumulated within the liquid receiver 5, thus reducing a disparity of the composition between the refrigerant actually circulating in the refrigeration cycle and the initially charged refrigerant, thereby inhibiting a change in the composition of the refrigerant. Also, the refrigerant flowing through the liquid connecting piping 9*b* is transformed into the form of a two-phase mixture by the first pressure reducer 4, thus reducing the mass of the refrigerant contained in the liquid connecting piping 9*b*, thereby reducing the amount of the refrigerant in the overall refrigeration cycle.

A description will now be given of various embodiments of the gas-liquid mixing device arranged in the refrigeration cycle with reference to FIGS. 4, 5 and 6.

Figure 4:
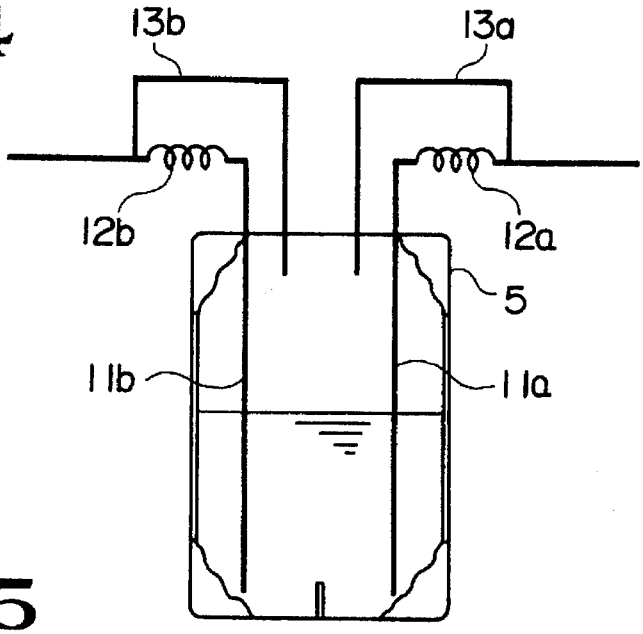
FIG. 4 is a vertical sectional view of an example of a gas-liquid mixing device used in the refrigeration cycle in accordance with the present invention.

A gas-liquid mixing device shown in FIG. 4 includes: two refrigerant liquid inlet and outlet pipes 11*a* and 11*b* for introducing a refrigerant liquid into/from the liquid receiver 5; and refrigerant gas outlet pipes 13*a* and 13*b* for introducing a refrigerant gas from the top portion of the liquid receiver 5. These pipes are connected to the liquid connecting piping 9*b* shown in FIG. 1. The forward ends of the refrigerant liquid inlet and outlet pipes 11*a* and 11*b* extend to the bottom of the liquid receiver 5. Pressure-reducing functions 12*a* and 12*b* for adjusting the quality, that is, the pressure-reducing means, are respectively arranged forward of the connecting points between the refrigerant liquid inlet and outlet pipes 11*a* and 11*b* and the refrigerant gas outlet pipes 13*a* and 13*b*, respectively.

In such a gas-liquid mixing device shown in FIG. 4, the refrigerant in the form of a two-phase mixture passes through one refrigerant liquid inlet and outlet pipe 11*a* so as to flow into the liquid receiver 5. Then, the refrigerant passes through the other refrigerant liquid inlet and outlet pipe 11*b* and is subjected to the adjustment of the liquid amount by the quality adjustment pressure-reducing function 12*b* so as to flow from the liquid receiver 5. Meanwhile, a gaseous phase in the top portion of the liquid receiver 5 flows out by the refrigerant gas outlet pipe 13*b* so as to be mixed with the liquid phase flowing through the refrigerant liquid inlet and outlet pipe 11*b*. The amount of the pressure reduced by the quality adjustment pressure-reducing function 12*b* is determined so that the quality or wetness of the resultant refrigerant has the same degree of that of the refrigerant in the form of a two-phase mixture flowing through the refrigerant liquid inlet and outlet pipe 11*a*, or so that the refrigerant becomes dry. Thus, the possible excess liquid refrigerant can be stored or accumulated in the liquid receiver.

Figure 5:
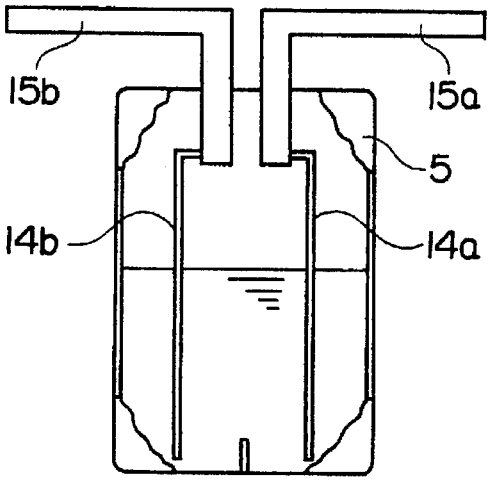
FIG. 5 is a vertical sectional view of another example of the gas-liquid mixing device used in the refrigeration cycle in accordance with the present invention.

A gas-liquid mixing device shown in FIG. 5 comprises two refrigerant inlet and outlet pipes 15*a* and 15*b* and refrigerant liquid outlet pipes 14*a* and 14*b*. The forward portions of the refrigerant inlet and outlet pipes 15*a* and 15*b* are arranged within the top portion of the liquid receiver. The refrigerant liquid outlet pipes 14*a* and 14*b* are each connected at one end to each of the forward ends of the refrigerant inlet and outlet pipes 15*a* and 15*b*. The other end of each of the refrigerant liquid outlet pipes 14*a* and 14*b* is inserted into the bottom of the liquid receiver 5. The refrigerant inlet and outlet pipes 15*a* and 15*b* are connected to the liquid connecting piping 9*b* shown in FIG. 1.

In the gas-liquid mixing device shown in FIG. 5, a refrigerant in the form of a two-phase mixture is introduced to the liquid receiver 5 through one of the refrigerant inlet and outlet pipes 15*a* and 15*b*. A gas phase is extracted from the top portion of the liquid receiver 5 through a gas extracting opening, which is the end opening of the other refrigerant inlet and outlet pipe, while a liquid phase is extracted from the liquid receiver 5 through a liquid extracting opening, which is the end opening of the refrigerant liquid outlet pipe which is connected to the refrigerant inlet and outlet pipe from which a gas is currently introduced. Such gas and liquid are thus mixed within the refrigerant inlet and outlet pipe so as to be discharged as a refrigerant in the form of a two-phase mixture.

Figure 6:
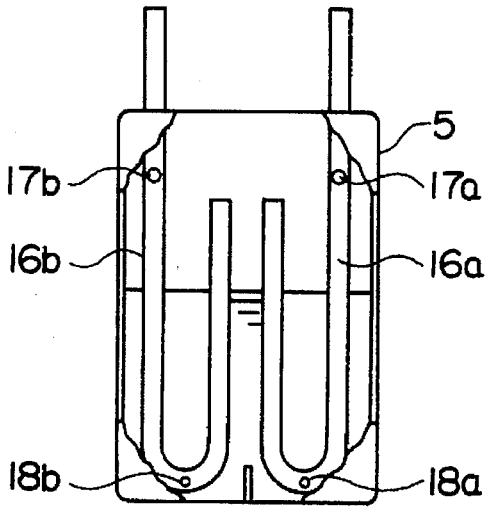
FIG. 6 is a vertical sectional view of still another example of the gas-liquid mixing device used in the refrigeration cycle in accordance with the present invention.

Further, a gas-liquid mixing device shown in FIG. 6 is constructed such that U-shaped pipes 16*a* and 16*b* are inserted into the liquid receiver 5. Gas outlets 17*a* and 17*b*, that is, the gas extracting openings, are provided for the U-shaped pipes 16*a* and 16*b*, respectively, so as to be positioned within the top portion of the liquid receiver 5. Liquid outlets 18*a* and 18*b*, that is, the liquid extracting openings, are provided for the U-shaped pipes 16*a* and 16*b*, respectively, so as to be positioned to face the bottom of the liquid receiver 5. The ends of the U-shaped pipes 16*a* and 16*b* projecting from the liquid receiver 5 are connected to the liquid connecting pipe 9*b* shown in FIG. 1.

In such a gas-liquid mixing device shown in FIG. 6, a refrigerant in the form of a two-phase mixture is introduced to the liquid receiver 5 through one of the U-shaped pipes 16*a* and 16*b*. A gas phase is extracted from the top portion of the liquid receiver 5 through the gas outlet of the other U-shaped pipe, while a liquid phase is extracted from the bottom of the liquid receiver 5 through the liquid outlet of the above-mentioned U-shaped pipe. Such gas and liquid are mixed within the U-shaped pipe so as to be discharged as a refrigerant in the form of a two-phase mixture.

The other operations of the gas-liquid mixing devices illustrated in FIGS. 5 and 6 which have not been discussed above are similar to those of the gas-liquid mixing device shown in FIG. 4.

A description will now be given of the efficiency of the operation of the refrigeration cycle according to the present invention.

Figure 7:
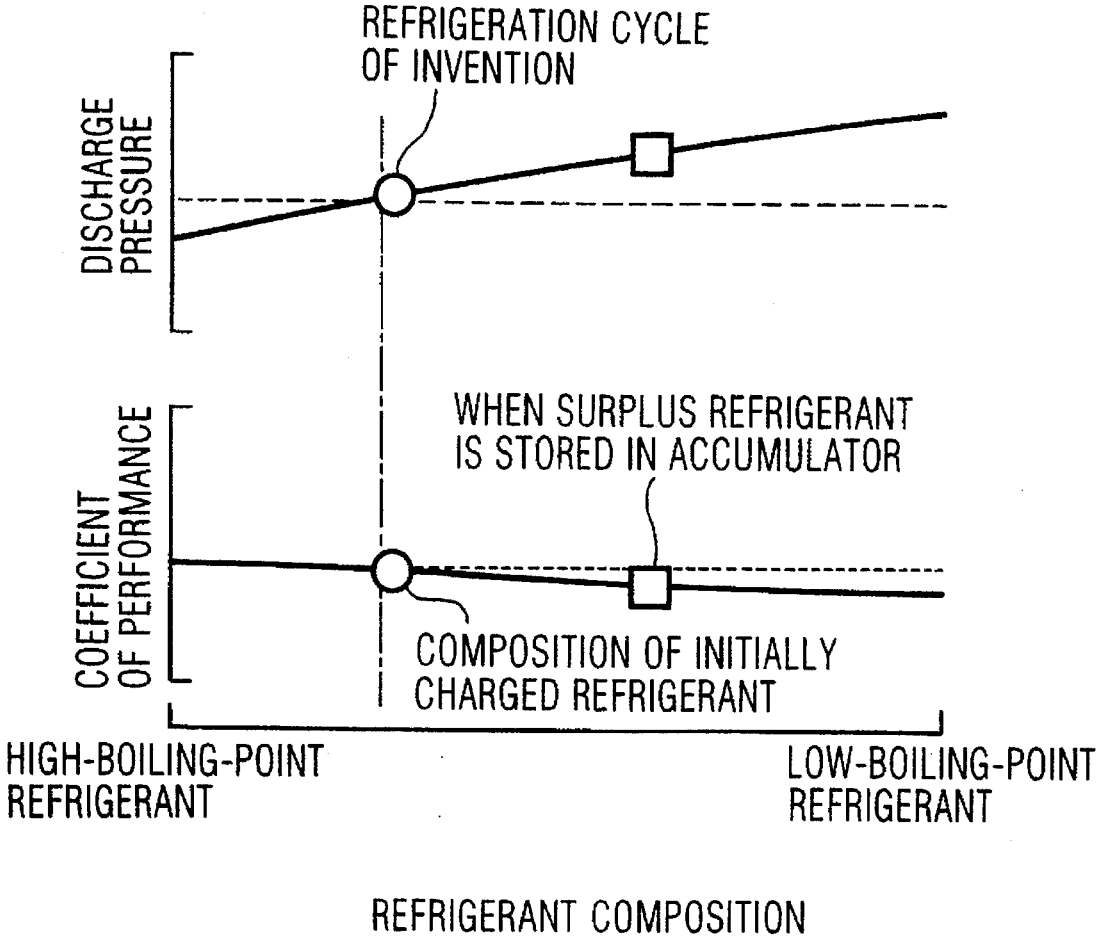
FIG. 7 is a diagram showing the relationship between the composition of a mixture refrigerant circulated through a refrigeration cycle and the operation efficiency of the refrigeration cycle.

FIG. 7 illustrates the relationship between the efficiency of the operation of the refrigerant cycle and the composition of the mixture refrigerant flowing through the refrigeration cycle.

The following can be seen from FIG. 7. When a surplus refrigerant is stored or accumulated within the tank provided for the low pressure side, such as the accumulator, a liquid refrigerant stored or accumulated as a surplus refrigerant results in a composition which is richer in the high-boiling point component, as shown in FIG. 2. Accordingly, the refrigerant mixture flowing through the refrigerant cycle results in a composition which is richer in the low-boiling point component, thus increasing the discharge pressure, thereby decreasing the efficiency of the operation of the refrigeration cycle. In contrast thereto, when a surplus refrigerant is stored or accumulated in the liquid receiver, a liquid refrigerant is stored or accumulated as a surplus refrigerant approximates that of the initially charged refrigerant. Accordingly, the composition of the refrigerant mixture flowing through the refrigeration cycle becomes closer to that of the initially charged refrigerant, as illustrated in FIG. 3, thus suppressing an increase in the discharge pressure, thereby inhibiting a decrease in the efficiency of the operation of the refrigeration cycle.

In the refrigeration cycle constructed as described above, a surplus refrigerant can be stored or accumulated in a liquid phase having a very small degree of as that obtained at the outlet of the condenser, the composition of such a liquid refrigerant approximating that of the initially charged liquid refrigerant. This suppresses a change in the mixture refrigerant actually flowing through the refrigeration cycle, thus inhibiting an increase in the operation pressure of the refrigeration cycle, thereby extending the limit of operating conditions. Also, the refrigerant flowing through the piping upstream and downstream of the liquid receiver is in the form of a two-phase mixture, thus reducing the amount of the initially charged liquid refrigerant. Accordingly, even if connecting piping is enlarged, the amount of the refrigerant required in the refrigerant cycle can be decreased.

Further, a surplus refrigerant is stored or accumulated in the liquid receiver, and accordingly, the composition of the mixture refrigerant flowing through the refrigerant cycle becomes close to that of the initially charged refrigerant, thereby inhibiting a decrease in the efficiency of the operation of the refrigeration cycle.

Although in the foregoing embodiments of the refrigeration cycle, electronic expansion valves are used as the first and second pressure reducers, capillary tubes, thermostatic expansion valves, or a mechanism for adjusting the amount of the pressure reduced, may be used. Further, the first and second pressure reducers may be in different types. In such a case, advantages similar to those obtained in the foregoing embodiments can be achieved.

An explanation will now be given of one example of a control process for the refrigeration cycle according to the present invention.

Figure 8:
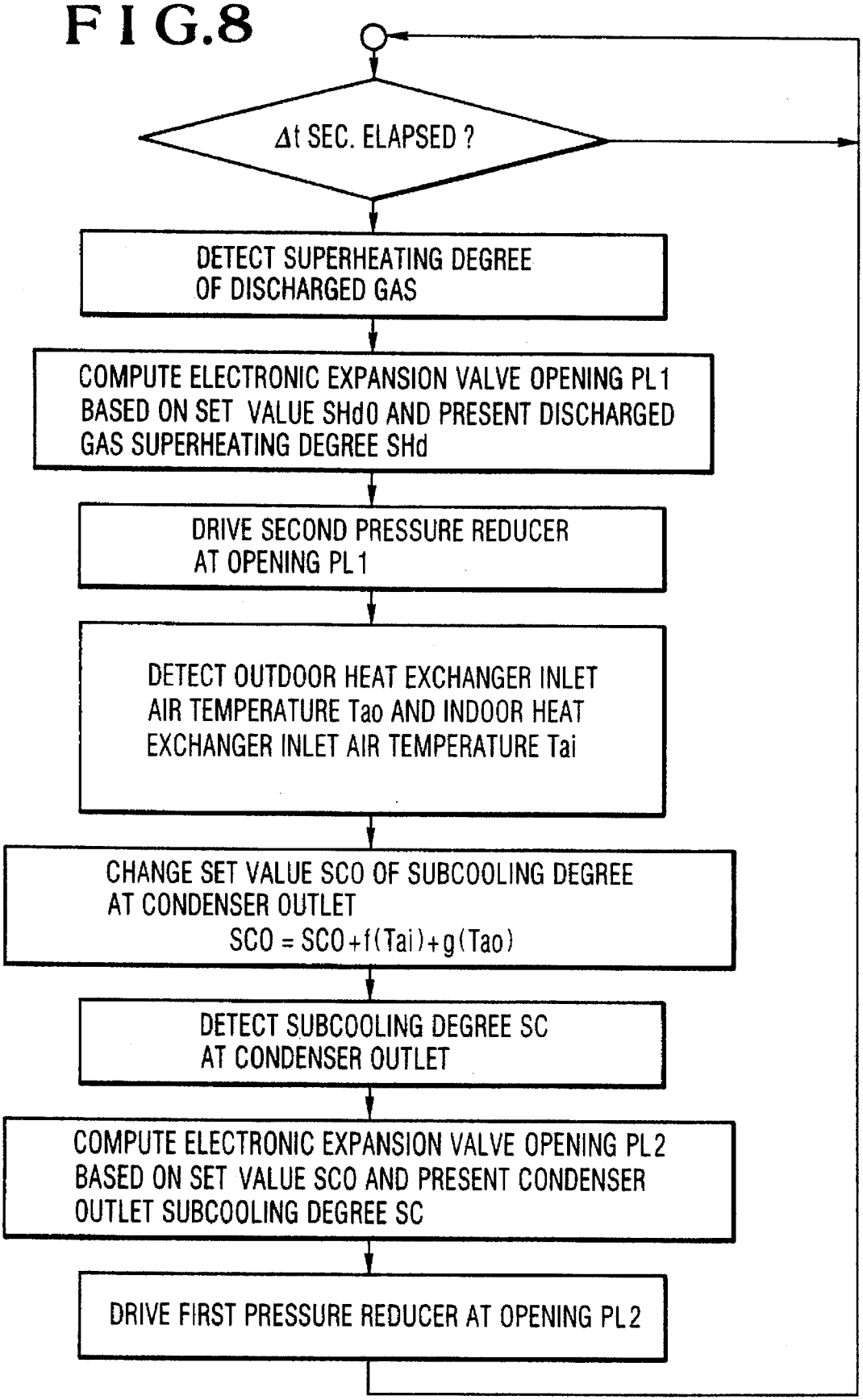
FIG. 8 is a flow chart showing heating operation of an air conditioner in accordance with an embodiment of a refrigeration cycle control method of the present invention.
Figure 9:
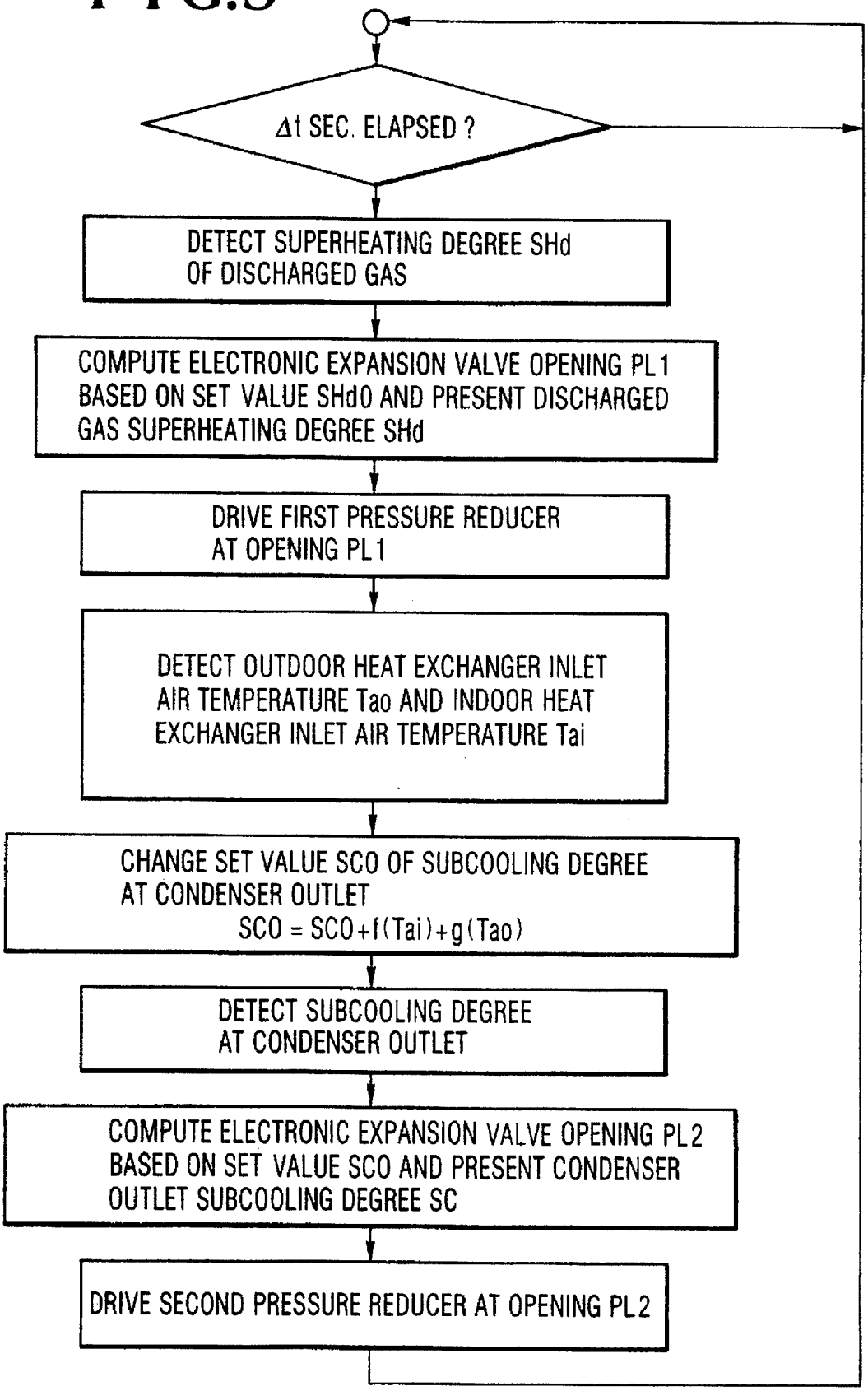
FIG. 9 is a flow chart showing cooling operation of an air conditioner in accordance with an embodiment of a refrigeration cycle control method of the present invention.

FIG. 1 illustrates a refrigeration cycle and a control system for controlling such a cycle. FIGS. 8 and 9 are flow charts of the heating operation and the cooling operation, respectively.

In this embodiment electronic expansion valves are used as the first and second pressure reducers 4 and 6 illustrated in FIG. 1.

As illustrated in FIG. 1, the control system comprises: a microcomputer 20; a memory 21 connected to the microcomputer 20; a temperature detection section 22 for detecting the temperatures of the air flowing in the heat exchangers; a super-heating-degree detection section 23 for detecting the superheating degree of a discharge gas; a heating-operation subcooling-degree detection section **24*a* for detecting the subcooling degree at the outlet of the condenser; a cooling-operation subcooling-degree detection section 24*b* for detecting the subcooling degree at the outlet of the condenser; expansion valve drive circuits 25*a* and 25*b* for driving the electronic expansion valves used as the first and second pressure reducers 4 and 6, respectively; and temperature detectors 26*a*–26*e***.

At least two types of refrigerants at different boiling points are mixed and charged in the foregoing refrigeration cycle. In this embodiment, a mixture of two types of refrigerants is used. Also, as a matter of convenience, a description will be given of an example in which the subcooling degree obtained at the outlet of the condenser and the superheating degree of the discharge gas are controlled as control values of the refrigeration cycle.

Set values for controlling the control values of the refrigeration cycle are stored in the memory 21 so as to be sent in response to a command from the microcomputer 20.

The foregoing temperature detection section 22 fetches the detected temperatures of the air flowing into the indoor and outdoor heat exchanges 3 and 7 from the temperature detectors **26*a* and 26*b*, respectively. The detection section 22 then converts the resultant values to electric signals and transmits them to the microcomputer 20**.

The foregoing super-heating-degree detection section 23 fetches the detected temperature of the discharge gas from the temperature detector **26*c*, which discharge gas is discharged from the compressor 1. The detection section 23 then converts the resultant value to an electric signal and transmits it to the microcomputer 20**.

The foregoing heating-operation and cooling-operation subcooling-degree detection sections **24*a* and 24*b* fetch the detected temperatures detected at the outlets of the indoor and outdoor heat exchanges 3 and 7, respectively, which are used as condensers, which temperatures are fetched from the temperature detectors 26*d* and 26*e*. The detection sections 24*a* and 24*b* then convert the resultant values into electric signals and transmit them to the microcomputer 20**.

The microcomputer 20 fetches the resultant values from the respective detection sections so as to compute the opening degrees of the electronic expansion valves used as the first and second pressure reducers 4 and 6 and to transmit the computed values to the expansion valve drive circuits **25*a* and 25*b***.

A description will now be given of the method of controlling the refrigeration cycle in heating and cooling modes.

(1) Operation in Heating Mode

In the operation of the refrigeration cycle in heating mode, as shown in FIG. 8, the superheating degree SHd of the gas discharged from the compressor is detected by a discharge gas superheating degree detecting section 23 after elapse of a predetermined time Δt seconds from the start. Then, the microcomputer 20 computes the opening degree PL1 of the electronic expansion valve, through PID, and neuro and fuzzy-processing, based on the set value SHd0 of the superheating degree of the discharged gas which is set beforehand in the memory 21. The computed opening degree PL1 of the electronic expansion valve is delivered to the expansion valve driving circuit **25*a* of the second pressure reducer 6 so that the opening degree of the second pressure reducer 6 is set to PL1. Meanwhile, the heat exchanger air inlet temperature detecting section 22 detects the temperature Tao of the air flowing into the outdoor heat exchanger 7 and the temperature Tai of the air flowing into the indoor heat exchanger 3. Then, the microcomputer 20 performs computation on the set value SCO of condenser outlet subcooling degree which is set beforehand in the memory 21, by using the function f of the temperature Tai of the air flowing into the indoor heat exchanger and the function g of the temperature Tao of the air flowing into the outdoor heat exchanger 7, thereby determining optimum condenser outlet subcooling degree. The thus determined optimum subcooling degree is then set as the set value SCO in the memory 21 so as to substitute for the old set value SCO. Then, the heating condenser outlet subcooling degree detecting section 24*a* detects the degree SC of subcooling at the condenser outlet. Then, the microcomputer 20 performs computation including PID and neuro and fuzzy processing on the detected condenser outlet subcooling degree SC, based on the set value SCO set in the memory 21, thereby determining the opening degree PL2 of the electronic expansion valve. The opening degree PL2 thus determined is delivered to the expansion valve drive circuit 25*b* for the first pressure reducer 4, so that the opening degree of the first pressure reducer 4** is set to PL2.

Thus, in the control method as described, the degree of subcooling of the refrigerant at the condenser outlet is controlled by the first pressure reducer 4 which is disposed upstream of the liquid receiver 5, so that the degree of quality or wetness of the refrigerant flowing into the liquid receiver 5 is controlled to a level substantially equal to that of the refrigerant flowing out the liquid receiver 5. Consequently, the level of the liquid refrigerant in the liquid receiver is maintained substantially constant, whereby the composition of the refrigerant actually circulated through the refrigeration cycle is stabilized. At the same time, the amount of liquid back to the compressor 1 is controlled by the second pressure reducer 6 which is disposed downstream of the liquid receiver 5, so that the refrigeration cycle is operated with a high degree of stability. In the event that the temperature Tai of the air flowing into the indoor heat exchanger is elevated, the condenser outlet subcooling degree SCO is set to a smaller value, thus suppressing rise of the pressure of the refrigerant discharged from the compressor, whereby the range of operation of the refrigeration cycle is expanded. In the event that the temperature Tai of the air flowing into the indoor heat exchanger 3 or the temperature Tao of the air flowing into the outdoor heat exchanger has come down, the condenser outlet subcooling degree SCO is set to a greater value so as to enable the refrigerant to be compressed to a higher pressure, thus enhancing the heating power of the refrigeration cycle. When the condenser outlet subcooling degree is set to a smaller value, the pressure to which the refrigerant is compressed by the compressor is lowered, so that the requirement for the power to be input to the compressor is correspondingly reduced to realize an energy-saving mode of the operation. Conversely, when the condenser outlet subcooling degree is set to a greater value, the discharge pressure is elevated to provide a greater heating power, thereby realizing a strong heating mode of the operation. A high efficiency of air conditioning can therefore be achieved by combining these two modes of operation such that the condenser outlet subcooling degree is set first to a large value while the difference between the command temperature and the measured temperature of the air to be conditioned is still large so as to enable the air to be heated up quickly and, after the above-mentioned difference in air temperature has become small, the condenser outlet subcooling degree is set to a smaller value so as to switch the operation to the energy-saving mode. The described operation, however, is only illustrative and may be modified such that the user can freely select the energy saving mode by operating a switch installed on a remote controller, even when the difference between the measured air temperature and the command air temperature is still large. Thus, according to the invention, the refrigeration cycle can be operated in a desired operation mode in accordance with the selection by the user.

(2) Operation in Cooling Mode

In the operation of the refrigeration cycle in cooling mode, as shown in FIG. 9, the superheating degree SHd of the gas discharged from the compressor is detected by a discharge gas superheating degree detecting section 23 after elapse of a predetermined time Δt seconds from the start. Then, the microcomputer 20 computes the opening degree PL1 of the electronic expansion valve, through PID, and neuro and fuzzy-processing, based on the set value SHd0 of the superheating degree of the discharged gas which is set beforehand in the memory 21. The computed opening degree PL1 of the electronic expansion valve is delivered to the expansion valve driving circuit **25*b* of the first pressure reducer 4 so that the opening degree of the first pressure reducer 4 is set to PL1. Meanwhile, the heat exchanger air inlet temperature detecting section 22 detects the temperature Tao of the air flowing into the outdoor heat exchanger 7 and the temperature Tai of the air flowing into the indoor heat exchanger 3. Then, the microcomputer 20 performs computation on the set value SCO of condenser outlet subcooling degree which is set beforehand in the memory 21, by using the function f of the temperature Tai of the air flowing into the indoor heat exchanger and the function g of the temperature Tao of the air flowing into the outdoor heat exchanger 7, thereby determining optimum condenser outlet subcooling degree. The thus determined optimum subcooling degree is then set as the set value SCO in the memory 21 so as to substitute for the old set value SCO. Then, the heating condenser outlet subcooling degree detecting section 24*b* detects the degree SC of subcooling at the condenser outlet. Then, the microcomputer 20 performs computation including PID and neuro and fuzzy processing on the detected condenser outlet subcooling degree SC, based on the set value SCO set in the memory 21, thereby determining the opening degree PL2 of the electronic expansion valve. The opening degree PL2 thus determined is delivered to the expansion valve drive circuit 25*a* for the second pressure reducer 6, so that the opening degree of the second pressure reducer 6** is set to PL2.

Thus, in the control method as described, the degree of subcooling of the refrigerant at the condenser outlet is controlled by the second pressure reducer 6 which is disposed upstream of the liquid receiver 5, so that the degree of quality or wetness of the refrigerant flowing into the liquid receiver 5 is controlled to a level substantially equal to that of the refrigerant flowing out the liquid receiver 5. Consequently, the level of the liquid refrigerant in the liquid receiver is maintained substantially constant, whereby the composition of the refrigerant actually circulated through the refrigeration cycle is stabilized. At the same time, the amount of liquid back to the compressor 1 is controlled by the first pressure reducer 4 which is disposed downstream of the liquid receiver 5, so that the refrigeration cycle is operated with a high degree of stability. In the event that the temperature Tai of the air flowing into the indoor heat exchanger is elevated, the condenser outlet subcooling degree SCO is set to a smaller value, thus suppressing rise of the pressure of the refrigerant discharged from the compressor, whereby the range of operation of the refrigeration cycle is expanded. In the event that the temperature Tai of the air flowing into the indoor heat exchanger 3 or the temperature Tao of the air flowing into the outdoor heat exchanger has come down, the condenser outlet subcooling degree SCO is set to a greater value so as to enable the refrigerant to be compressed to a higher pressure, thus enhancing the heating power of the refrigeration cycle. When the condenser outlet subcooling degree is set to a smaller value, the pressure to which the refrigerant is compressed by the compressor is lowered, so that the requirement for the power to be input to the compressor is correspondingly reduced to realize an energy-saving mode of the operation. Conversely, when the condenser outlet subcooling degree is set to a greater value, the discharge pressure is elevated to increase the waste of heat from the outdoor heat exchanger 7, thus offering a greater cooling power, thereby realizing a strong cooling mode of the operation. A high efficiency of air conditioning can therefore be achieved by combining these two modes of operation such that the condenser outlet subcooling degree is set first to a large value while the difference between the command temperature and the measured temperature of the air to be conditioned is still large so as to enable the air to be cooled down quickly and, after the above-mentioned difference in air temperature has become small, the condenser outlet subcooling degree is set to a smaller value so as to switch the operation to the energy-saving mode. The described operation, however, is only illustrative and may be modified such that the user can freely select the energy saving mode by operating a switch installed on a remote controller, even when the difference between the measured air temperature and the command air temperature is still large. Thus, according to the invention, the refrigeration cycle can be operated in a desired operation mode in accordance with the selection by the user.

As will be understood from the foregoing description, according to the described embodiment of the refrigeration cycle control method of the present invention, the degree of subcooling of the refrigerant at the condenser outlet is controlled by the pressure reducer which is disposed upstream of the liquid receiver 5 as viewed in the direction of flow of the refrigerant, while the amount of liquid back to the compressor 1 is controlled by the pressure reducer which is disposed downstream of the liquid receiver 5. According to this control method, it is possible to maintain a substantially constant level of the liquid refrigerant in the liquid receiver and to stabilize the operation of the refrigeration cycle. Furthermore, it is possible to intentionally lower or raise the pressure of the refrigerant discharged from the compressor, by changing the set value SCO of the subcooling degree of the refrigerant at the condenser outlet, in accordance with changes in the temperature Tai of the air flowing into the indoor heat exchanger 3 or the temperature Tao of the air flowing into the outdoor heat exchanger 7, this realizing expansion of the range over which the refrigeration cycle can operate, as well as enhancement of the cooling or heating power. Furthermore, the user can freely set the operation of the refrigeration cycle to a mode which gives greater importance to saving of energy or to a mode which gives preference to the heating or cooling power. By selectively using these modes of operation, the user can obtain a desired condition of air conditioning well adapting to the state of the air to be conditioned.

Although the degree of subcooling of the refrigerant at the condenser outlet and the degree of superheating of the refrigerant discharged from the compressor have been specifically mentioned as control objects in the control method of the present invention, thee parameters are only illustrative and the control method of the invention can be carried out equally well by using alternative control objects. For instance, the above-described advantages of the control method in accordance with the present invention can equally be enjoyed when the condenser outlet subcooling degree is substituted by another parameter such as the pressure inside the liquid receiver, the degree of quality or wetness at the condenser outlet or the level of the liquid refrigerant inside the liquid receiver, while the superheating degree at the compressor outlet is replaced with another parameter such as the degree of superheating of the refrigerant sucked by the compressor, degree of quality or wetness of the refrigerant sucked by the compressor, or degree of super-heating, degree of quality or degree of wetness of the refrigerant at the outlet of the outdoor hat exchanger.

It is to be understood also that the electronic expansion valves, which are used as the first and second pressure reducers in the described embodiment, may be substituted by other suitable type of expansion valves such as capillary-tube type expansion valves, thermal expansion valves or other suitable mechanism capable of varying the extent of decompression, without impairing the effects produced by the described embodiment.

According to the invention as set fort in claim 2, a refrigeration cycle comprises a liquid receiver which is connected between the indoor heat exchanger and the outdoor heat exchanger, and a gas-liquid mixing device which mixes gas and liquid and which is disposed at the outlet side of the piping connected to the liquid receiver as viewed in the direction of flow of the refrigerant flowing through the piping, whereby the refrigeration cycle operates such that the refrigerant at the inlet to the liquid receiver is a two-phase mixture comprising gaseous phase and liquid phase or such that the pressure inside the liquid receiver is maintained intermediate between the pressure of the high-pressure side and the pressure of the low-pressure side of the refrigeration cycle. According to this arrangement, any surplus refrigerant is stored as a liquid refrigerant having small degree of quality as that obtained at the condenser outlet. Thus, the composition of the refrigerant stored in the liquid receiver approximates that of the initially charged refrigerant. Consequently, variation of the composition of the mixture refrigerant circulated through the refrigeration cycle is suppressed to restrain the operation pressure of the refrigeration cycle from rising, thus achieving an expanded range of operation of the refrigeration cycle. In addition, since the refrigerant flows in two-phase mixture state through the piping upstream and downstream of the liquid receiver, the amount of the liquid refrigerant can be decreased, thus permitting a reduction in the amount of the refrigerant to be used in the refrigeration cycle, while improving the efficiency of operation of the same, even when a long piping is used between components such as indoor and outdoor heat exchangers.

According to the invention as set forth in claim 3, the liquid receiver is disposed at an intermediate-pressure region of the refrigeration cycle, and the gas-liquid mixing device is so disposed as to maintain the refrigerant flowing into or flowing out the liquid receiver in a two-phase mixture state which consists of both of the gaseous phase and liquid phase of the refrigerant. In this arrangement also, any surplus refrigerant can be stored as a liquid refrigerant having a very small degree of quality as that obtained at the condenser outlet. Consequently, the refrigerant stored in the liquid receiver exhibits a composition which approximates that of the initially charged refrigerant. In other words, only a slight difference exists between the composition of the refrigerant circulated through the refrigeration cycle and the initially charged refrigerant. Consequently, variation of the composition of the mixture refrigerant circulated through the refrigeration cycle is suppressed to restrain the operation pressure of the refrigeration cycle from rising, thus achieving an expanded range of operation of the refrigeration cycle. In addition, since the refrigerant flows in two-phase mixture state through the piping upstream and downstream of the liquid receiver, the mass of the refrigerant in the piping can be decreased, thus permitting a reduction in the amount of the refrigerant to be used in the refrigeration cycle, while improving the efficiency of operation of the same, even when a long piping is used between components such as indoor and outdoor heat exchangers.

In the invention as set forth in claim 4 or 5, the gas-liquid mixing device comprises a gas pipe which extracts the gaseous phase of the refrigerant in the liquid receiver from the top of the liquid receiver, a liquid pipe for extracting the liquid phase of the refrigerant from the liquid receiver, and pressure reducing means provided in the liquid pipe. In this form of the invention, the gaseous phase and the liquid phase extracted from the top and the liquid portion of the liquid receiver through the gas pipe and the liquid pipe, respectively, are mixed together to form a two-phase mixture refrigerant which has the same degree of quality or wetness as the two-phase mixture refrigerant flowing into the liquid receiver or a greater degree of quality than the two-phase mixture refrigerant flowing into the liquid receiver. Consequently, any surplus refrigerant generated in the refrigeration cycle is stored in the liquid receiver in the form of a liquid refrigerant having a composition approximating that of the initially charged refrigerant. At the same time, refrigerant in the state of a two-phase mixture is constantly discharged from the liquid receiver through the gas-liquid mixing device.

According to the invention as set forth in claim 6 or 7, the gas-liquid mixing device comprises a gas extraction opening through which gaseous phase is extracted from the liquid receiver, a liquid extraction opening through which liquid phase is extracted from the liquid receiver, and a refrigerant outlet pipe for mixing the extracted gaseous phase and liquid phase together and delivering the mixture. The composition of the liquid refrigerant stored in the liquid receiver approximates that of the initially charged refrigerant, and refrigerant in the state of a two-phase mixture is constantly discharged from the liquid receiver through the gas-liquid mixing device also in this case.

According to the invention as set forth in claim 8 or 9, at least one of the first and second pressure reducers disposed upstream and downstream of the liquid receiver may be an electronic expansion valve. Such an electronic expansion valve makes it possible to optimumly control the operation of the refrigeration cycle well following up the load imposed on the refrigeration cycle.

According to the invention as set fort in claim 10, a refrigeration cycle control method is provided for controlling a refrigeration cycle of the type which comprises, at least, a compressor, a four-way valve, an indoor heat exchanger, a first pressure reducer, a liquid receiver, a second pressure reducer, an outdoor heat exchanger, a piping through which the compressor, the four-way valve, the indoor heat exchanger, the first pressure reducer, the liquid receiver, the second pressure reducer and the outdoor heat exchanger are connected in sequence, and a non-azetropic mixture refrigerant charged in the refrigeration cycle, comprising at least two kinds of refrigerants of different boiling temperatures mixed together. The refrigeration cycle control method comprising operating at least one of the first and second pressure reducers such that the degree of the refrigerant subcooling in one of the indoor and outdoor heat exchangers serving as a condenser or the pressure in the liquid receiver is controlled by one of the first and second pressure reducers which is upstream of the liquid receiver as viewed in the direction of flow of the refrigerant, while the degree of super-heating of the gaseous phase of the refrigerant discharged by the compressor or sucked into the compressor is controlled by the pressure reducer which is disposed downstream of the liquid receiver.

When the level of the load imposed by the air is high, the pressure reducer upstream of the liquid receiver functions to suppress rise of the discharge pressure, while the amount of liquid back to the compressor is optimized by the pressure reducer which is downstream of the liquid receiver, whereby refrigeration cycle can operate over a wider range of operation under optimum conditions. The operation of the refrigeration cycle can be set to a mode which gives a greater importance to saving of energy or to a mode which give preference to capacity, by setting the degree of subcooling of the refrigerant at the condenser outlet or the pressure inside the liquid receiver to a suitable level. It is therefore possible to operate the refrigeration cycle in a fashion which is optimum for the space to be air-conditioned or which is desired by the user.

Figure 10:
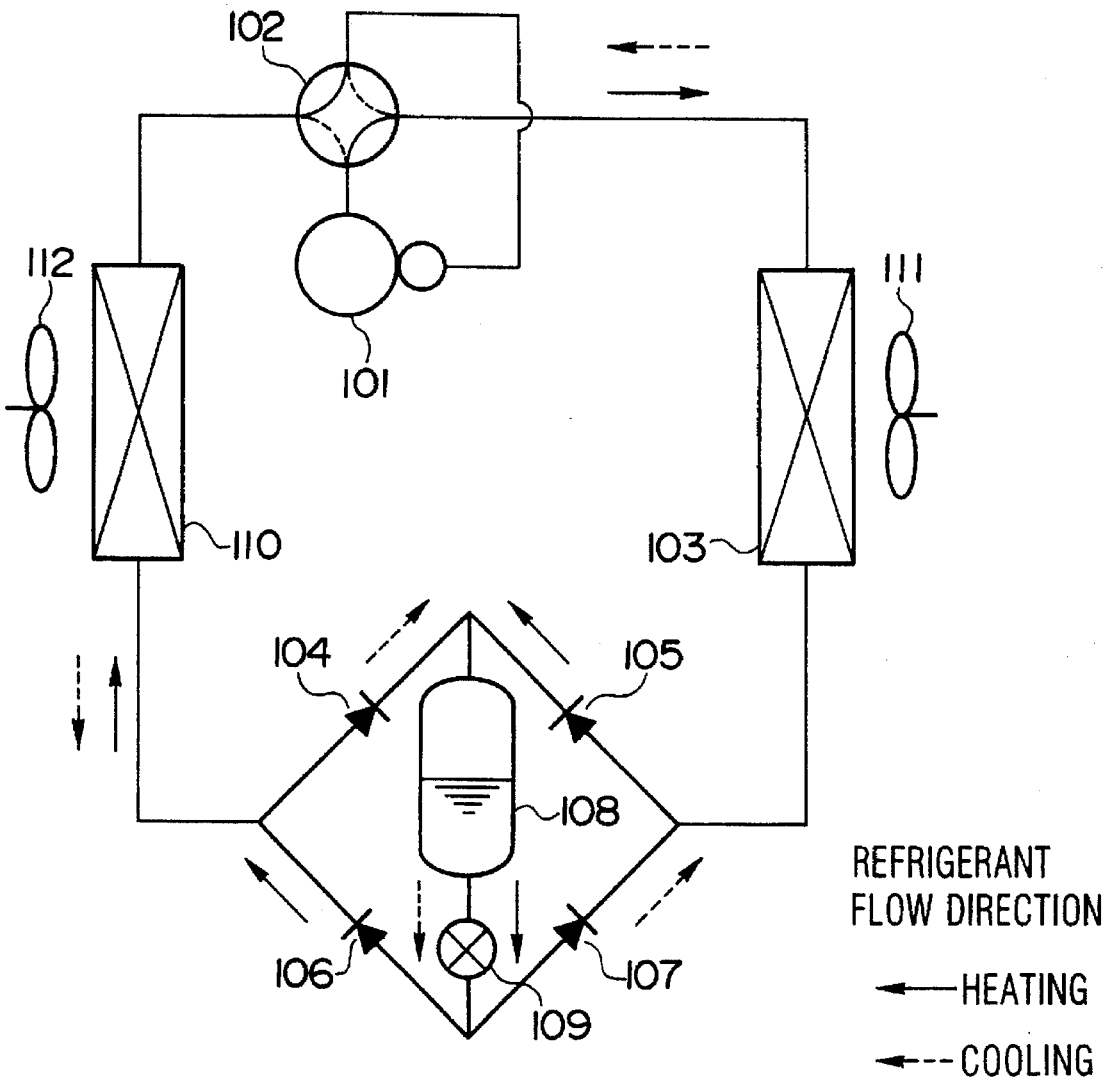
FIG. 10 is an illustration of the construction of a refrigeration cycle embodying the present invention, wherein a refrigerant passage changeover device is incorporated.

A description will now be given of an embodiment of the present invention of the type having a refrigerant passage changeover means. FIG. 10 illustrates the construction of a refrigeration cycle embodying the present invention, having means for changing over the passages of the refrigerant. The refrigeration cycle shown in FIG. 10 includes a compressor 101, a four-way valve 102 as the refrigerant passage changeover device which performs switching between the compressor suction and discharge passages in accordance with a switching between the cooling mode and the heating mode of operation of the refrigeration cycle, am indoor heat exchanger 103, a liquid receiver 108, an expansion valve 109 as pressure reducer and an outdoor heat exchanger 110, and four check valves 104, 105, 106 and 107 which collectively serve as refrigerant passage change-over means which perform switching between the passage through which the refrigerant flows into the liquid receiver and the passage through which the refrigerant is discharged from the liquid receiver through the expansion valve . These components are connected in sequence to form a closed loop of refrigeration cycle, and a non-azeotropic mixture refrigerant such as HFC-32/134 or HFC-32/125/134a is charged in this closed loop. The indoor heat exchanger is provided with an indoor blower 111, while the outdoor heat exchanger 110 is provided with an outdoor blower 112.

Figure 11:
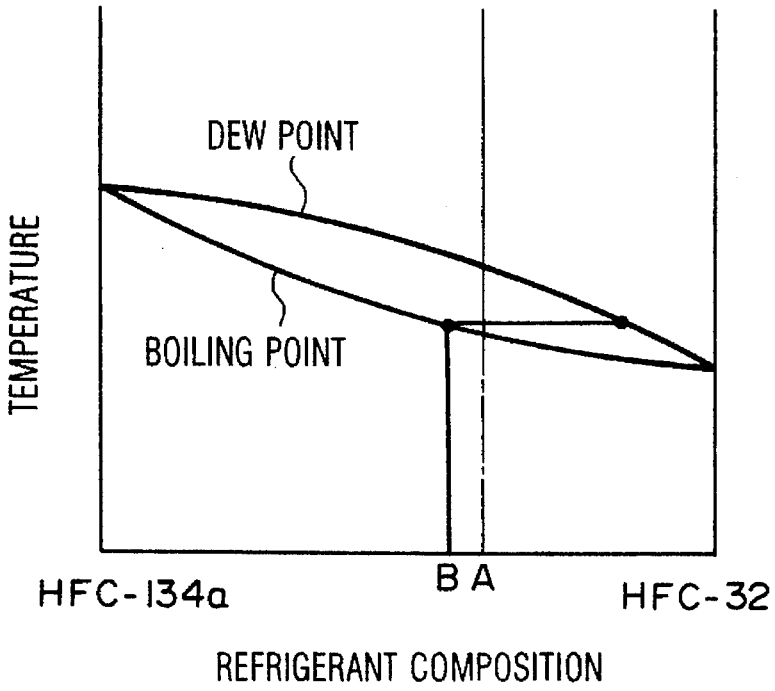
FIG. 11 is a diagram showing gas-liquid equilibrium state, illustrative of the operation of the embodiment shown in FIG. 10.
Figure 12:
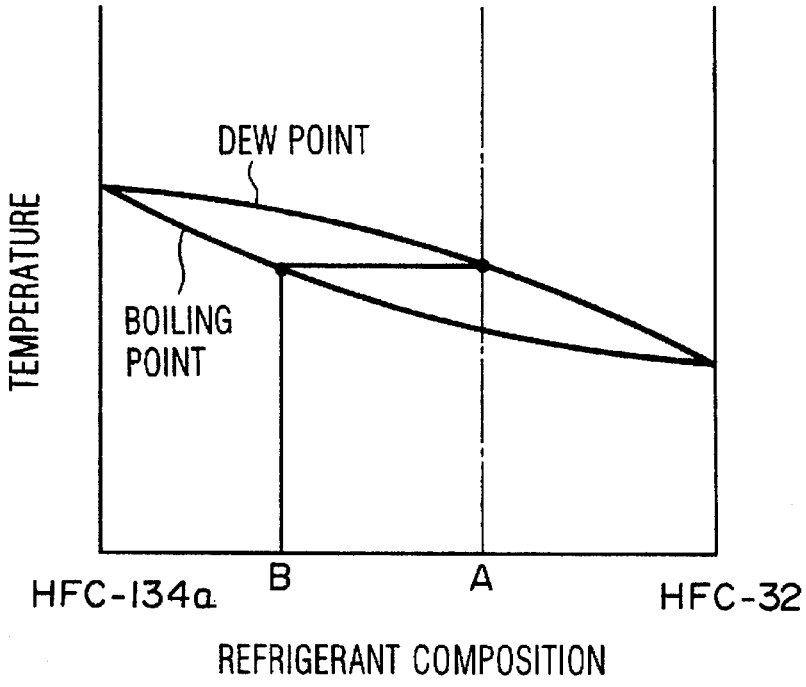
FIG. 12 is a diagram showing gas-liquid equilibrium state illustrative of a problem to be solved by the embodiment shown in FIG. 10.

The operation of the refrigeration cycle having the described construction will be described, beginning with the description of the operation in heating mode. As indicated by solid-line arrows in FIG. 10, the refrigerant compressed to high pressure and temperature is introduced through the four-way valve 102 into the indoor heat exchanger 103 so as to be condensed into liquid phase therein by giving heat to the air which is blown through the indoor heat exchanger 103 by the indoor blower 111. The liquefied refrigerant is introduced through the check valve 105 into the liquid receiver 108. In this embodiment, the refrigerant is introduced into the liquid receiver 108 after being liquefied in the condenser 103. In non-steady state of operation, therefore, surplus refrigerant is stored in liquid phase. However, since the refrigerant flowing into the liquid receiver 108 has a small degree of dryness, only a slight difference exists as shown in FIG. 11 between the composition A of the refrigerant flowing into the liquid receiver and the composition B of the refrigerant stored in the liquid receiver. Therefore, the difference in composition between the refrigerant circulated through the refrigeration cycle and the refrigerant initially charged i appreciably small in the steady operation of the refrigeration cycle. Furthermore, the refrigerant discharged from the liquid receiver 108 is decompressed through the expansion valve 109 and is then introduced into the check valve 106 of the low-pressure side without flowing towards the check valve 107 connected to the high-pressure side. The refrigerant then flows into the outdoor heat exchanger 110 without flowing towards the check valve 104 connected to the high-pressure side, so as to be evaporated by heat derived from the air which is blown through the outdoor heat exchanger 110 by the outdoor blower 112. The evaporated refrigerant is then sucked by the compressor 101.

In cooling mode of the operation of the described refrigeration cycle, the refrigerant gas compressed to high pressure and temperature by the compressor 101 is introduced to the outdoor heat exchanger 110 through the four-way valve 101 as indicated by broken-line arrows, and is condensed into liquid phase by giving heat to the air which is supplied to the outdoor heat exchanger 110 by the outdoor blower 112. The liquid refrigerant thus obtained is then introduced into the liquid receiver 108 in the same direction as that in the operation in the heating mode, through the check valve 104. As described before, the refrigerant flowing into the liquid receiver 108 has a small degree of quality, so that the difference between the composition of this refrigerant and that of the refrigerant discharged from the liquid receiver is small. The refrigerant flowing out the liquid receiver 108 is decompressed through the expansion valve 109 and is then directed to the check valve 107 of the low-pressure side without flowing towards the check valve 106 which is connected to the high-pressure side. The refrigerant is then introduced into the indoor heat exchanger 103 without flowing towards the check valve 105 connected to the high-pressure side, so as to be evaporated by the heat derived from the air which is blown through the indoor heat exchanger 103 by the indoor blower 111. The refrigerant which is now in gaseous phase is then sucked by the compressor 101.

As will be understood from the foregoing description, in this embodiment of the refrigeration cycle in accordance with the present invention, the liquid receiver 108 is connected between the heat exchanger which serves as the condenser and the pressure reducer, both in the cooling and heating modes of operation of the refrigeration cycle. According to this arrangement, the difference in composition between the refrigerant initially charged and the refrigerant which is actually circulated is made sufficiently small, thus suppressing substantial increase in the proportion of the inflammable HFC-32 in the refrigerant circulated through the refrigeration cycle. Furthermore, since the change in the composition of the refrigerant is suppressed, it is possible to use, as the expansion valve, an automatic thermal expansion valve having a feeler bulb charged with the same refrigerant as that charged in the refrigeration cycle. Furthermore, since only one pressure reducer is used, the system for controlling the pressure reducer is simplified as compared with the case where a plurality of pressure reducers are used.

Figure 13:
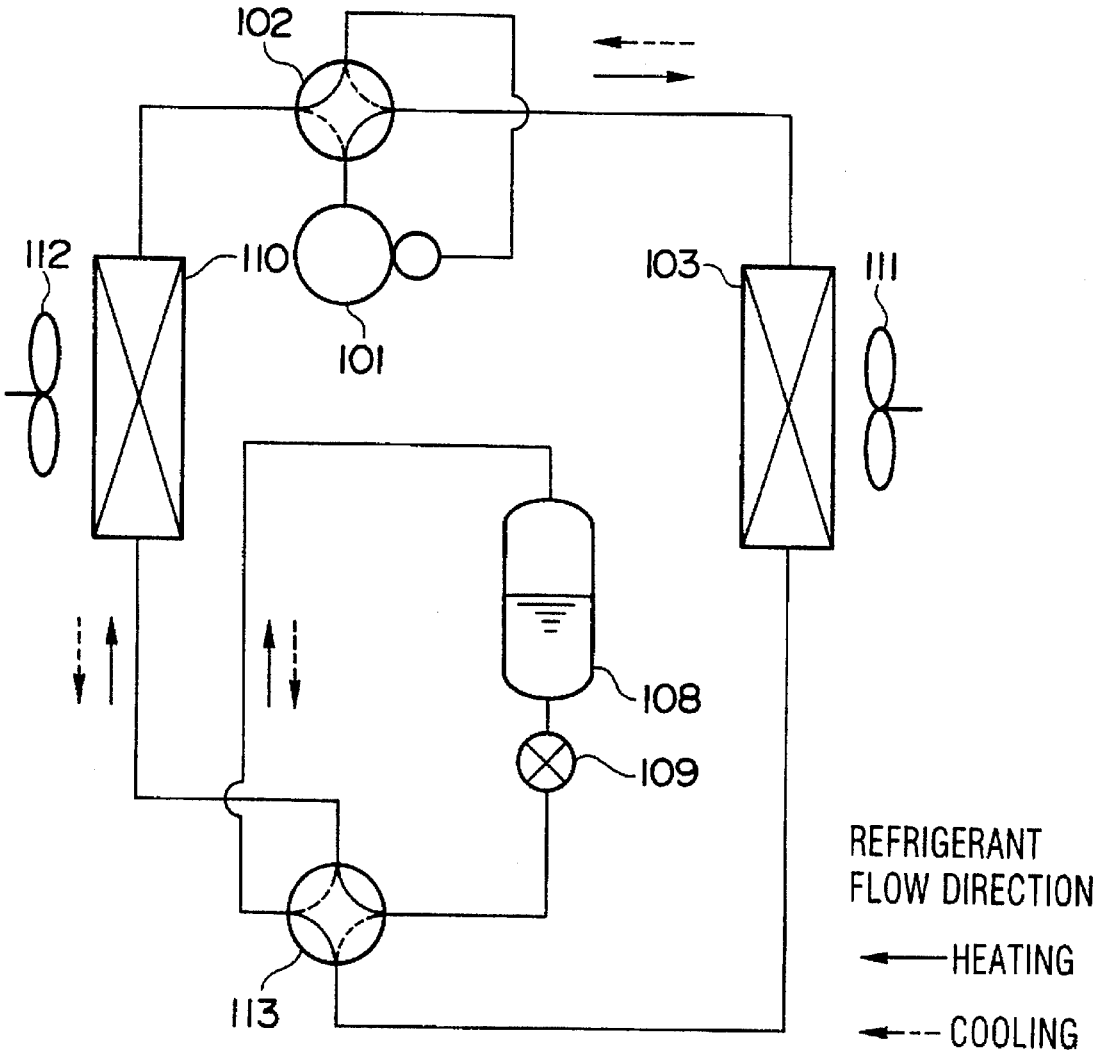
FIG. 13 is an illustration of the construction of a modification of the refrigeration cycle shown in FIG. 10.

A description will now be given with specific reference to FIG. 13 as to a modification of the embodiment of the refrigeration cycle shown in FIG. 10. This modification employs a single second four-way valve 113 in place of the four check valves used in the embodiment shown in FIG. 10 as the means for changing over the refrigerant passages to and from the liquid receiver.

In operation of this modification in heating mode, the gaseous refrigerant compressed by the compressor 101 to high pressure and temperature is introduced into the indoor heat exchanger 103 through the four-way valve 102 so as to be condensed therein by giving heat t the air which is blown through the indoor heat exchanger 103 by the indoor blower 111. The refrigerant thus liquefied is then introduced into the second four-way valve 113 which has been switched to allow the refrigerant to flow into the liquid receiver 108. Consequently, the refrigerant is introduced into the liquid receiver 108. As stated before, the refrigerant flowing into the liquid receiver 108 has a small degree of quality, so that only a slight difference exists in composition between the refrigerant flowing into the liquid receiver 108 and that of the refrigerant flowing out the liquid receiver. The refrigerant discharged from the liquid receiver 108 is decompressed through the expansion valve 109 and is introduced through the second four-way valve 113 into the outdoor heat exchanger 110 so as to be evaporated therein by the heat derived from the air which is blown through the outdoor heat exchanger 110 by the outdoor blower 112. The evaporated refrigerant is then sucked by the compressor 101.

In the cooling mode of operation of thus modification, each of the four-way valves 102 and 113 is switched so that the refrigerant flows in the refrigeration cycle in the reverse direction to that in the heating mode. However, as in the case of the operation in heating mode, the refrigerant discharged from the liquid receiver is introduced to the expansion valve 109. This modification makes it possible to realize an appreciably small difference in composition between the initially charged refrigerant and the refrigerant which is actually circulated through the refrigeration cycle, as in the case of the embodiment described in connection with FIG. 10. In addition, the reliability of the refrigeration cycle is improved by virtue of the reduced number of parts which is realized by the use of the single four-way valve.

Figure 14:
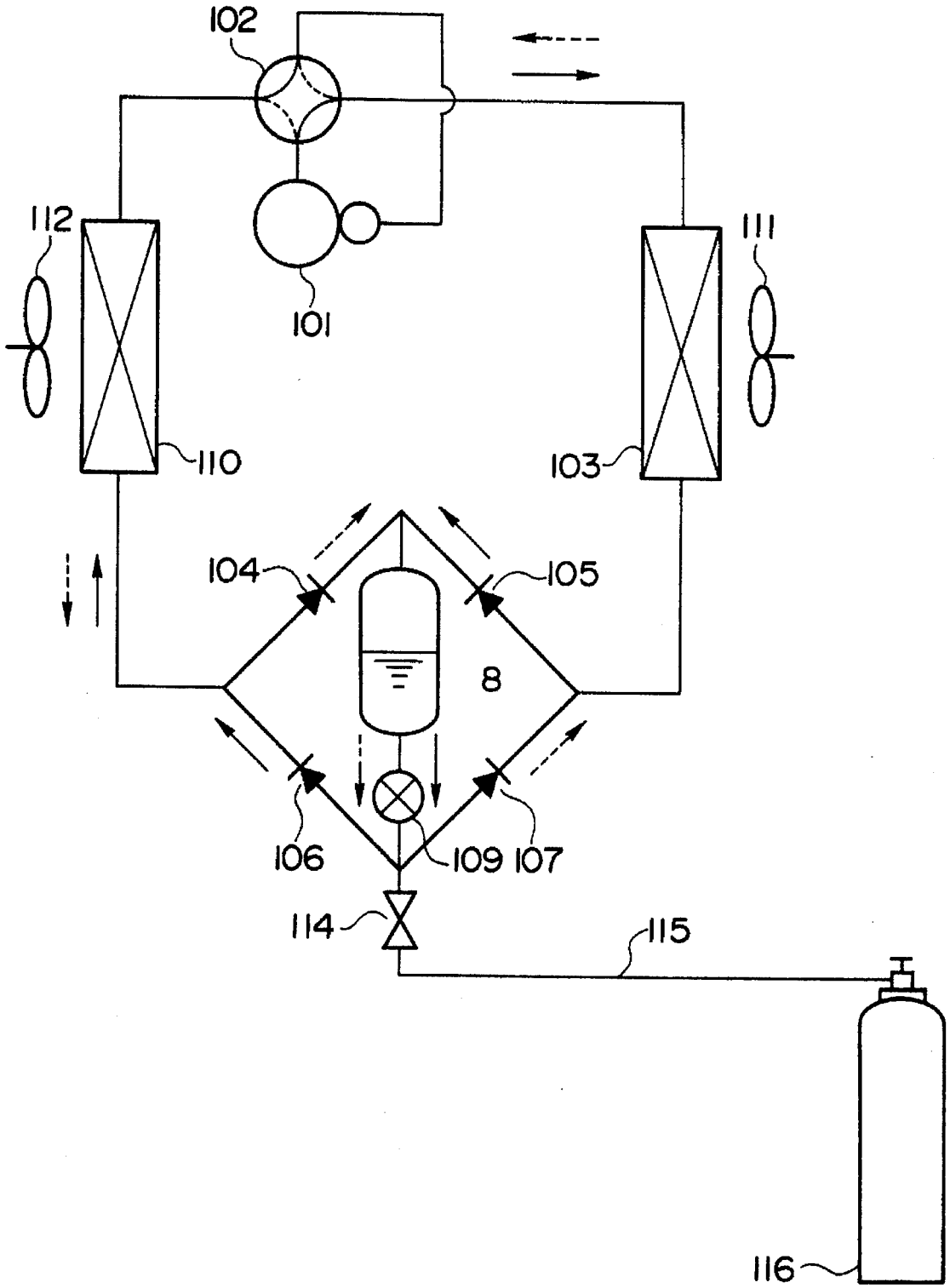
FIG. 14 is an illustration of the construction of another modification of the refrigeration cycle shown in FIG. 10.

Another modification of the embodiment shown in FIG. 10 will now be described with reference to FIG. 14. The modification shown in this figure is basically the same as the embodiment shown in FIG. 10 but is discriminated therefrom by the provision of a refrigerant makeup valve 114 for additional charging of the refrigerant at the outlet said of the expansion valve 109. For the purpose of additionally charging the refrigeration cycle by the refrigerant, the user connects a refrigerant cylinder 116 to a refrigerant makeup pipe 115 and, after purging air from this pipe 115, connects the latter to the refrigerant make-up valve 114. The outlet of the expansion valve 119 is held at low pressure regardless of whether the operation is being performed in heating or cooling mode, so that the refrigerant can be charged into the refrigeration cycle by pressure difference as the refrigerant makeup valve 114 is opened. The refrigerant thus charged is evaporated through the evaporator and is then sucked by the compressor 101, thus eliminating the risk of direct sucking of liquid refrigerant into the compressor 101.

Figure 15:
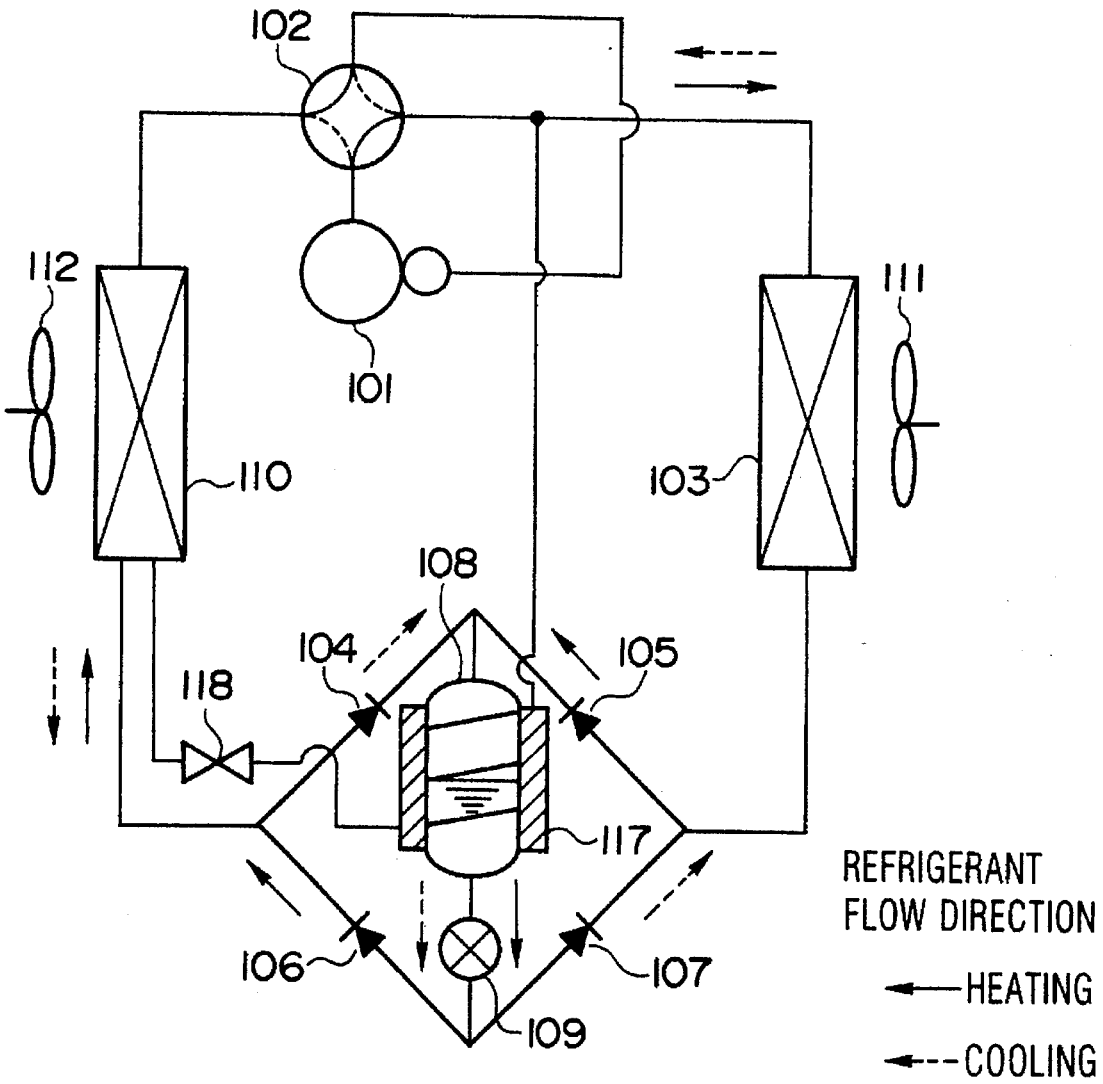
FIG. 15 is an illustration of the construction of still another modification of the refrigeration cycle shown in FIG. 10.

A description will now be given of still another modification of the embodiment shown in FIG. 10, with specific reference to FIG. 15. This modification features that the heat accumulated in the liquid receiver is used for defrosting purpose. More specifically, a heat accumulating member 17 is disposed so as to surround the liquid receiver 108. The heat accumulating member 117 is connected to the outdoor heat exchanger 110 through a pipe having a two-way valve 118.

The operation of this refrigeration cycle is as follows. In normal heating operation of the refrigeration cycle, heat possessed by the refrigerant in the liquid receiver 108 is delivered to and accumulated in the heat accumulating member 117. When defrosting cycle s started, the four-way valve 102 is switched to cooling mode position and the two-way valve 118 is opened. Consequently, the refrigerant gas compressed by the compressor 101 to high pressure and temperature is introduced into the outdoor hat exchanger 110 through the four-way valve 102 so as to remove frost from the outdoor heat exchanger 110. Consequently, the refrigerant is condensed into liquid phase. Most of the refrigerant is recirculated to the heat accumulating member 117 through the two-way valve 118 which provides smaller resistance to the flow of refrigerant, so that the refrigerant absorbs heat which has been transmitted from the liquid receiver 118 to the heat accumulating member 117. The refrigerant is then returned to the compressor 101. In this modification, therefore, the heat possessed by the refrigerant flowing into the liquid receiver 108 is efficiently utilized so as to shorten the defrosting time, while reducing electrical power used for the defrosting.

Figure 16:
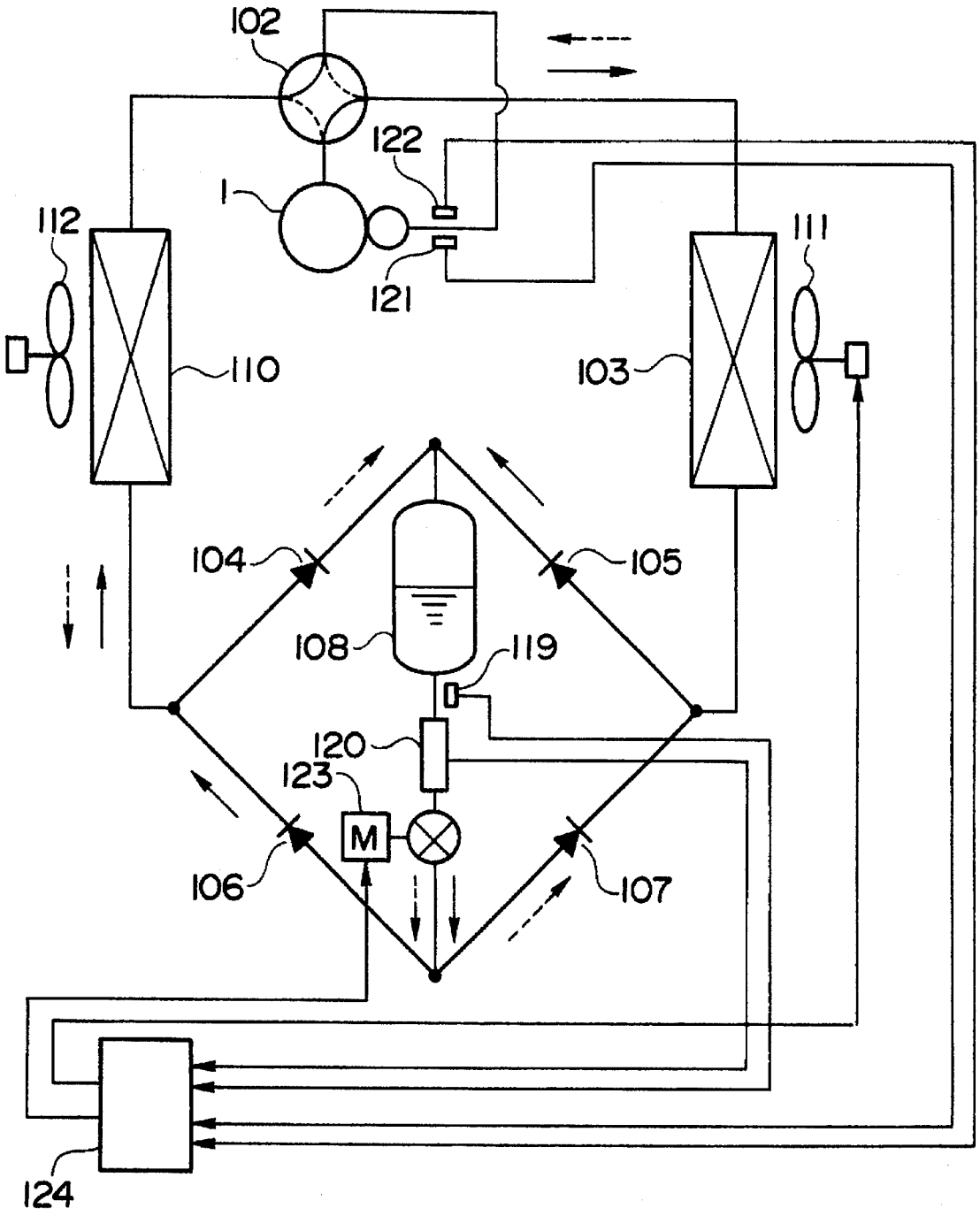
FIG. 16 is an illustration of the construction of a further modification of the refrigeration cycle shown in FIG. 10.

A description will now be given of a further modification of the embodiment shown in FIG. 10, with specific reference to FIG. 16. This embodiment is constructed so as to perform optimum control of the degree of super-heating. In this modification, a refrigerant composition detector, e.g., a combination of a temperature detector 119 and an electrostatic capacitance detector 120, is disposed at the outlet side of the liquid receiver 108 where liquid refrigerant flows without termination. At the same time, a compressor suction pressure detector 121 and a temperature detector 122 are provided at the inlet side of the compressor 101. The temperature detector 119 and the electrostatic capacitance detector 120 respectively detect the temperature and the electrostatic capacitance of the refrigerant discharged from the thermal receiver 108. The composition of the circulated refrigerant can be computed by using these two detected values. It is possible to determine the dew point of the refrigerant sucked by the compressor 101, based on the computed refrigerant composition and the suction pressure detected by the compressor suction pressure detector 121. A controller 124 performs such control of the opening degree of an electrically driven expansion valve 123 or the speed of the outdoor blower 111 in such a manner that the dew point and the refrigerant temperature detected by the temperature detector 122 on the suction side of the compressor are maintained at constant levels, i.e., such that the degree of super-heating is maintained constant. According to this arrangement, it is possible to conduct optimum control of degree of super-heating, even when the degree of quality of the refrigerant flowing into the liquid receiver is not small.

In this modification, when there is a shortage of the refrigerant in the refrigeration cycle, only gaseous phase refrigerant is discharged from the liquid receiver 108, so that the electrostatic capacitance detector 120 produces an output of a level which is largely different from those obtained when liquid refrigerant is being discharged from the liquid receiver. This modification may be arranged such that the controller 124 automatically stops the compressor 101 when it has determined that only gaseous refrigerant is flowing room the liquid receiver, based on the output from the electrostatic capacitance detector 120. Such an arrangement contributes to improvement in the reliability of the refrigeration cycle through elimination of damaging of the compressor.

As will be understood from the foregoing description, the embodiment shown in FIG. 10 and its modifications provide a refrigeration cycle operable both in cooling and heating modes and having a compressor, refrigerant passage changeover device, indoor heat exchanger, liquid receiver, pressure reducer and an outdoor heat exchanger which are connected in sequence, the refrigeration cycle being charged with a non-azeotropic mixture refrigerant comprising at least two kinds of refrigerants, the refrigeration cycle comprising refrigerant passage changeover means for performing changeover of refrigeration passages to and form the liquid receiver such that the refrigerant from a heat exchanger serving as a condenser always flows essentially in such a direction that it is introduced into the liquid receiver and then into the pressure reducer. In this refrigeration cycle, it is possible to maintain the composition of the circulated refrigerant approximating that of the refrigerant stored in the liquid receiver, even when the degree of dryness of the refrigerant flowing into the liquid receiver is reduced due to change in the level of the load imposed on the refrigeration cycle.

What is claimed is:

1. A refrigeration cycle comprising, at least: a compressor; an indoor heat exchanger; a first pressure reducer; a second pressure reducer; an outdoor heat exchanger; a piping sequentially interconnecting said compressor, said indoor heat exchanger, said first pressure reducer, said second pressure reducer and said outdoor heat exchanger; a non-azeotropic mixture refrigerant comprising at least two kinds of refrigerants of different boiling temperatures mixed together and charged in said refrigeration cycle; a liquid receiver connected between said indoor heat exchanger and said outdoor heat exchanger; and a gas-liquid mixing device for mixing gas and liquid, disposed at the outlet side of the piping connected to said liquid receiver as viewed in the direction of flow of the refrigerant flowing through the piping; wherein the refrigerant at the inlet to said liquid receiver is maintained in the state of a two-phase mixture comprising gaseous phase and liquid phase or the pressure inside said liquid receiver is maintained intermediate between the pressure of the high-pressure side and the pressure of the low-pressure side of said refrigeration cycle.

2. A refrigeration cycle according to claim 1, wherein at least one of said first and second pressure reducers includes an electronic expansion valve.

3. A refrigeration cycle according to claim 1, wherein said gas-liquid mixing device comprises a gas pipe which extracts the gaseous phase of the refrigerant in said liquid receiver from the top of said liquid receiver, a liquid pipe for extracting the liquid phase of said refrigerant from said liquid receiver, and pressure reducing means provided in said liquid pipe.

4. A refrigeration cycle according to claim 1, wherein said gas-liquid mixing device comprises a gas extraction opening through which gaseous phase is extracted from said liquid receiver, a liquid extraction opening through which liquid phase is extracted from said liquid receiver, and a refrigerant outlet pipe for mixing the extracted gaseous phase and liquid phase together and delivering the mixture.

5. A refrigeration cycle comprising, at least: a compressor; an indoor heat exchanger; a first pressure reducer; a second pressure reducer; an outdoor heat exchanger; a piping sequentially interconnecting said compressor, said indoor heat exchanger, said first pressure reducer, said second pressure reducer and said outdoor heat exchanger are connected in sequence; a non-azetropic mixture refrigerant comprising at least two kinds of refrigerants of different boiling temperatures mixed together and charged in said refrigeration cycle; a liquid receiver connected between said indoor heat exchanger and said outdoor heat exchanger, said liquid receiver being disposed at an intermediate-pressure region of said refrigeration cycle; and a gas-liquid mixing device which maintains the refrigerant flowing into or flowing out said liquid receiver in the state of a two-phase mixture containing both the gaseous phase and liquid phase of the refrigerant.

6. A refrigeration cycle according to claim 5, wherein said gas-liquid mixing device comprises a gas pipe which extracts the gaseous phase of the refrigerant in said liquid receiver from the top of said liquid receiver, a liquid pipe for extracting the liquid phase of said refrigerant from said liquid receiver, and pressure reducing means provided in said liquid pipe.

7. A refrigeration cycle according to claim 5, wherein said gas-liquid mixing device comprises a gas extraction opening through which gaseous phase is extracted from said liquid receiver, a liquid extraction opening through which liquid phase is extracted from said liquid receiver, and a refrigerant outlet pipe for mixing the extracted gaseous phase and liquid phase together and delivering the mixture.

8. A refrigeration cycle according to claim 5, wherein at least one of said first and second pressure reducers includes an electronic expansion valve.

9. A refrigeration cycle control method for controlling a refrigeration cycle of the type which comprises, at least, a compressor, a four-way valve, an indoor heat exchanger, a first pressure reducer, a liquid receiver, a second pressure reducer, an outdoor heat exchanger, a piping sequentially interconnecting said compressor, said four-way valve, said indoor heat exchanger, said first pressure reducer, said liquid receiver, said second pressure reducer and said outdoor heat exchanger, and a non-azeotropic mixture refrigerant charged in said refrigeration cycle and comprising at least two kinds of refrigerants of different boiling temperatures mixed together, said refrigeration cycle control method comprising operating at least one of said first and second pressure reducers such that the degree of the refrigerant subcooling in one of said indoor and outdoor heat exchangers serving as a condenser or the pressure in said liquid receiver is controlled by one of said first and second pressure reducers which is upstream of said liquid receiver as viewed in the direction of flow of said refrigerant, while the degree of super-heating of the gaseous phase of the refrigerant discharged by said compressor or sucked into said compressor is controlled by the pressure reducer which is downstream of said liquid receiver.

* * * * *